US006196664B1

(12) United States Patent
Kanda et al.

(10) Patent No.: US 6,196,664 B1
(45) Date of Patent: Mar. 6, 2001

(54) INK DROPLET EJECT APPARATUS AND METHOD

(75) Inventors: Torahiko Kanda; Ryuichi Kojima; Yasuhiro Otsuka, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/012,459

(22) Filed: Jan. 23, 1998

(30) Foreign Application Priority Data

Jan. 30, 1997 (JP) ..... 9-016672

(51) Int. Cl.[7] ..... B41J 21/135
(52) U.S. Cl. ..... 347/46; 347/70
(58) Field of Search ..... 347/46, 47, 48, 347/44, 68, 70, 40, 42, 43

(56) References Cited

U.S. PATENT DOCUMENTS

| | | | | |
|---|---|---|---|---|
| 3,946,398 | | 3/1976 | Kyser et al. . | |
| 4,303,927 | * | 12/1981 | Tsao | 346/75 |
| 5,381,171 | * | 1/1995 | Hosono et al. | 347/72 |
| 5,565,113 | * | 10/1996 | Hadimioglu et al. | 216/2 |
| 5,589,864 | * | 12/1996 | Hadimioglu | 347/146 |
| 5,591,490 | * | 1/1997 | Quate | 427/457 |
| 5,646,662 | * | 7/1997 | Kitahara | 347/70 |
| 5,790,151 | * | 8/1998 | Mills | 347/47 |
| 5,828,394 | * | 10/1998 | Khuri-Yakub et al. | 347/72 |
| 5,912,679 | * | 6/1999 | Takayama et al. | 347/10 |
| 5,923,351 | * | 7/1999 | Hosono et al. | 347/68 |

FOREIGN PATENT DOCUMENTS

| | | |
|---|---|---|
| 61-59911 | 12/1986 | (JP) . |
| 63-162253 | 7/1988 | (JP) . |
| 4-14455 | 1/1992 | (JP) . |
| 4-299148 | 10/1992 | (JP) . |
| 4-355145 | 12/1992 | (JP) . |
| 5-508 | 1/1993 | (JP) . |
| 5-38810 | 2/1993 | (JP) . |
| 5-112008 | 5/1993 | (JP) . |
| 6-218926 | 8/1994 | (JP) . |

* cited by examiner

*Primary Examiner*—Richard Moses
(74) *Attorney, Agent, or Firm*—Young & Thompson

(57) ABSTRACT

An ink droplet eject apparatus comprises a plate-shaped member defining a conical ink droplet eject chamber increasing from an eject port to an opening, and a vibrating plate covering the opening. A spacer is disposed between the vibrating plate and the plate-shaped member surrounding the opening. An annular space is delimited by the spacer. An ink flow path is formed in the spacer. The vibrating plate is excited so as to generate an intermittent liquid flow of an ink W in the ink droplet eject chamber in the direction of the eject port. An actuator can arbitrarily control an amount of displacement of the vibrating plate and a generation time of displacement during the excitation.

12 Claims, 19 Drawing Sheets

Fig.22(A) PRIOR ARI
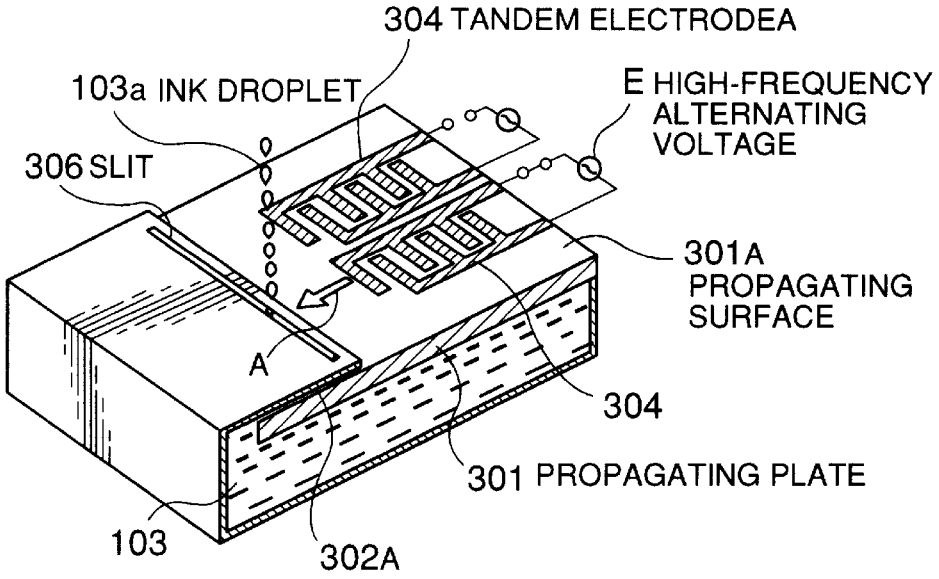
Fig.22(B) PRIOR ARI
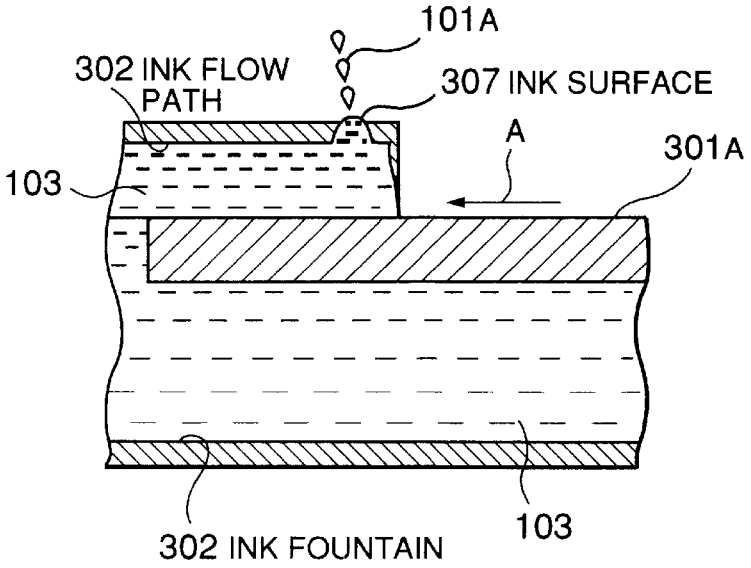

INK DROPLET EJECT APPARATUS AND METHOD

BACKGROUND OF THE INVENTION

1. Field of the Invention

The present invention relates to an ink droplet eject apparatus and method, and more specifically to an apparatus and method to eject a fine ink droplet suitable for graphic image printing on a printing medium.

2. Description of the Related Art

Various kinds of ink eject devices have been proposed, of which seven examples will described with reference to the accompanying drawings.

A first example shown in FIGS. 20(A) and 20(B) is an ink droplet eject apparatus for use in an ink jet printer or the like. As shown in FIG. 20(A), a piezoelectric element 101 is vibrated so as to expand the volume of an ink accommodating chamber 102. Liquid ink 103 is sucked from an ink tank (not shown). As shown in FIG. 20(B), the volume of the ink accommodating chamber 102 is then reduced so as to apply a pressure to the ink 103 therein. An ink droplet 103*a* is ejected from a nozzle 104 onto a printing medium such as a paper. This art is described in U.S. Pat. No. 3,946,398.

The invention described in Japanese Patent Publication No. 61-59911/1986 is similar to that in U.S Pat. No. 3,946, 398. In the Japanese publication, a heating element is contained in the ink droplet eject chamber. Heat energy causes a bubble to be instantaneously generated in the ink. An expansion force of the bubble causes the ink droplet to be ejected.

In the second example shown in FIG. 21, an ink fountain 202 is formed in a glass plate 200. A piezoelectric element 201 is provided for drawing the ink 103 along a flow path 204 into the ink fountain 202. Between a silicon board 205 and the glass plate 200 is disposed a dry film 206 which forms a space and a plurality of flow paths or the like. An eject heater 207 is heated. The heat energy causes a bubble to be instantaneously generated in the ink. The ink is ejected. This art is described in Japanese Patent Application Laid-open No. 5-112008/1993.

The second example is characterized in that inks having different dyestuff densities are supplied from a plurality of flow paths to the ink fountain 202 thereby allowing a density gradation.

Thus, in the above-described prior art, various ink droplet eject apparatuses using a pumping principle have been proposed.

On the other hand, ink droplet eject apparatus ejecting the ink in a mist state are described, for example, in Japanese Patent Application Laid-open No. 4-14455/1992, Japanese Patent Application Laid-open No. 4-299148/1992, Japanese Patent Application Laid-open No. 5-38810/1993, Japanese Patent Application Laid-open No. 4-355145/1992, and Japanese Patent Application Laid-open No. 5-508/1993.

A third example is disclosed in the above-listed Japanese Patent Application Laid-open No. 4-14455/1992.

In the third example, as shown in FIGS. 22(A) and 22(B), plural pairs of tandem electrodes 304 are formed at one end on a propagating surface 301A of a piezoelectric propagating plate 301. The electrodes 304 are used as drive means so as to apply a high-frequency alternating voltage E of about 20 MHz. The propagating surface 301A is excited so as to generate a surface elastic wave (surface wave). In this drawing, numeral 302 denotes the ink fountain. Numeral 302A denotes an ink flow path.

The generated surface elastic wave progresses in a direction shown by an arrow A. The surface elastic wave reaches a portion where the propagating surface 301A is in contact with the liquid ink 103. At this time, the surface elastic wave is transmitted to the ink 103 so as to be a longitudinal elastic wave (ultrasonic wave). This elastic wave causes an ink surface 307 exposed by a slit 306 to be excited. The ink droplet 103*a* is ejected in the mist state.

The fourth example shown in FIG. 23 is disclosed in Japanese Patent Application Laid-open No. 5-508/1993. In FIG. 23, a gap is formed between a slit member 308 and a resonator 309. An ink fountain 305 is disposed in the gap. Numeral 306 denotes a piezoelectric actuator.

In the fourth example, a capillary action initially causes the ink 103 to be filled in the ink fountain 305. A resonance vibration is applied to the resonator 309 in a thickness direction. Its vibration energy is propagated to the ink 103. Finally, random surface waves are formed on an ink interface 103A of an ink eject port 310. Interference of the surface waves causes an ink particle to be ejected in the mist state in accordance with a vibration frequency of the resonator 309.

The fifth example shown in FIG. 24 is disclosed in Japanese Patent Application Laid-open No. 5-38810/1993. In the fifth example, a pair of electrodes 403A and 403B are formed on both surfaces of a piezoelectric substrate 401. A nozzle plate 405 is joined to the piezoelectric substrate 401 via a gap support member 404. Capillary action causes the liquid ink 103 to be filled in the gap space.

An intersection region 406 is formed by the electrodes 403A and 403B. To the intersection region 406 is applied a voltage displaced by a resonant frequency determined by the thickness of the piezoelectric substrate 401. The piezoelectric substrate 401 is resonated so as to generate the ultrasonic wave in the liquid ink 103.

The generated ultrasonic wave is propagated in the ink 103. The surface wave is generated on the ink surface 103A of the ink 103 filled in a nozzle 405A just over the intersection region 406. When an amplitude of the surface wave is larger than the constant amplitude, the ink droplet 103*a* is discharged in the mist state.

Furthermore, a similar technique is also disclosed in Japanese Patent Application Laid-open No. No. 4-14455/1992, Japanese Patent Application Laid-open No. 4-299148/1992, Japanese Patent Application Laid-open No. 4-355145/1992, Japanese Patent Application Laid-open No. 5-508/1993 and Japanese Patent Application Laid-open No. 5-38810/1993. However, their means for generating the surface wave on an ink liquid surface are different from one another.

In any apparatus using as its ejecting principle an ultrasonic wave wetting apparatus, the surface wave is generated at random on a free surface of a liquid. The interference of the surface wave causes the ink droplet 103*a* to be ejected in the mist state from many unspecified ejecting points.

In addition, a sixth example shown in FIG. 25 is an ink droplet eject apparatus using an acoustic pressure by an acoustic streaming. It is disclosed in Japanese Patent Application Laid-open No. 63-162253/1988.

In this technique, as shown in FIG. 25, the vibration of a piezoelectric transducer 501 causes an ultrasonic acoustic wave to be generated. The ultrasonic acoustic wave is focused on one point on the free surface 103A of the ink 103 by a concave spherical surface acoustic lens portion 502A formed on an end surface (upper end surface in FIG. 25) of an acoustic lens body 502. When the acoustic wave collides with the free surface 103A of the ink 103, a radiation pressure is generated. The generated radiation pressure causes the ink droplet 103*a* to be ejected separately from the free surface 103A of the ink 103.

A seventh example shown in FIGS. 26(A) and 26(B) is an ink droplet eject apparatus using acoustic pressure by an acoustic streaming, as is the case with the sixth example described above. The seventh example is disclosed in Japanese Patent Application Laid-open No. 6-218926/1994.

In the ink droplet eject apparatus shown in FIG. 25, a plurality of piezoelectric elements 601 are disposed in a matrix. A predetermined voltage is applied to a group of piezoelectric elements 601 in a portion where the ink droplet is to be ejected. A concavity 602 is formed in order to concentrate a pressure wave. A high frequency voltage is then applied to the concavity so as to vibrate the concavity. This causes the ink droplet 103*a* to be ejected. Numeral 604 denotes the ink surface. Numeral 605 denotes an ink film layer. Reference character A denotes a direction of ink flow. Numeral 606 denotes a case body.

On the other hand, in various printers including ink jet type printers, a precise pictorial image output requires the ability to produce a continuous smooth density gradation from a high light side to shadow side.

The following methods are conventional for obtaining such gradation printing ability in the ink jet type printers. In one method, an amount of ink droplet to be ejected is varied for each pixel so as to perform a density modulation. In an other method, one pixel is composed of a plurality of ink droplets finer than a pixel size so as to perform the density modulation in accordance with the number of ink droplets. In either method, in order to express a smooth gradation without a gradation jump, a technique which ejects ink droplets sufficiently finer than the pixel size is essential.

However, in the above-described conventional ink droplet eject apparatus, it is difficult to realize the continuous smooth density gradation printing characteristics for the following reasons.

In the first and second examples of FIGS. 20(A), 20(B), and 21, each apparatus operates by the pumping principle. Therefore, the diameter of a minimum ejectable ink droplet is substantially the same as that of a nozzle.

Thus it is impossible in practice to eject a fine ink droplet, for example, having 1/10th the diameter of the nozzle diameter.

Ejecting fine ink droplets with these ink droplet eject apparatuses requires a reduced nozzle diameter according to a desired ink droplet diameter. However, the reduction of the nozzle diameter easily causes a clogging of the nozzle. Thus, reliability and durability of the overall apparatus deteriorates. Therefore, in the above-described conventional ink eject apparatus, it has been very difficult to form a fine ink droplet having a diameter of, for example, a few $\mu$m to 20 $\mu$m.

Moreover, the reduction of the nozzle diameter requires high precision manufacturing techniques. Therefore, in the ink droplet eject apparatus using the pump principle, besides the clogging of the nozzle described above, there is an inconvenience that productivity is low.

Furthermore, in the second example shown in FIG. 21, inks having different dyestuff densities can be ejected from one nozzle so as to perform a density graduation. However, it is difficult to uniformly mix the ink 103 and to continue ejecting it with a good reproducibility. Moreover, since an eject heater 207 and a piezoelectric element 201 are necessary, the cost of the ink droplet eject apparatus is increased.

Furthermore, in the third example, a surface wave is generated on a free surface of the liquid so that the ink droplet is ejected in a mist state. Also in the ink droplet eject apparatus described in Japanese Patent Application Laid-open No. 4-299148/1992, Japanese Patent Application Laid-open No. 4-355145/1992, and the above fourth and fifth examples, a fine ink droplet having a diameter of about a few $\mu$m can be ejected in the mist state. Changing the eject time makes it possible to control the number of ink droplets to be ejected.

However, these ink droplet eject apparatuses adopt a construction wherein the interference is caused by surface waves generated at random on the free surface of the liquid. Therefore, ink droplets are ejected in the mist state from many unspecified ink droplet eject points. This creates a variation in the diameter of the ink droplet to be ejected. Moreover, the ejecting direction and ejecting velocity also vary for each ink droplet.

Thus, there is a disadvantage in controllability per ink droplet necessary for an ink jet printing head. That is, it is difficult to control a shot position of the ink droplet on the printing medium and an ink amount of the shot with high accuracy and stability.

Moreover, in the sixth example, the availability of vibration energy is low. Thus, a piezoelectric transducer 501 of FIG. 25 generating each ink droplet 103*a* is required to be large in size. Disadvantageously, this requires the size of the apparatus to be increased.

Furthermore, since a depth of focus of an acoustic lens is very shallow, means for realizing a high-accuracy control of the free ink surface position is necessary. Moreover, the acoustic lens is necessary for each ultrasonic vibrator. Disadvantageously, this causes the apparatus construction to be complicated.

In the seventh example, although the size of each piezoelectric element is small, a group of many piezoelectric elements 601 is necessary. A predetermined voltage is applied to each of the piezoelectric elements 601. Therefore, the construction is complicated, thereby disadvantageously resulting in the rise of the cost of the ink droplet eject apparatus.

Furthermore, an electric system needs a circuit construction having a band for passing a signal of a few hundreds of MHz such as a high frequency power amplifying/generating portion for performing an oscillation and an amplification of a high frequency signal from a few MHz to a few hundreds of MHz and a high frequency power switch portion for printing. Disadvantageously, this also increases the cost of the apparatus.

SUMMARY OF THE INVENTION

An object of the present invention is an ink droplet eject apparatus which overcomes the disadvantages of the prior art, and more specifically allows an ink droplet much finer than its opening to be ejected drop by drop onto a desired shot position, to realize a density gradation by varying the size of the ink droplet, and which has a simplified construction and is easy to make.

Another object of the present invention is an ink droplet eject apparatus in which a residual bubble in an ink droplet eject chamber can be easily removed, thereby contributing to a smooth operation of the overall apparatus.

In order to achieve the above objects, an ink droplet eject apparatus of the present invention comprises a plate-shaped eject chamber forming member including an ink droplet eject chamber having an ink droplet eject port of a conical section, that is, whose section decreases in cross-section approaching the exterior of the chamber. The ink droplet eject apparatus comprises a vibrating plate disposed on the other surface of the eject chamber forming member so as to cover the ink droplet eject chamber at a predetermined distance.

A spacer member is disposed between the vibrating plate and the eject chamber forming member so as to surround a bottom surface region of the ink droplet eject chamber, that is, the opening on the other side, and the vibrating plate is supported so as to vibrate freely in a wider area than said opening. A space is defined between the vibrating plate and the eject chamber forming member, and the spacer member. The space communicates with the bottom surface region of the ink droplet eject chamber. An ink flow path is formed between the vibrating plate and the eject chamber forming member, and connected to the space.

An actuator excites the vibrating plate so as to generate an intermittent liquid flow of ink in the ink droplet eject chamber from the bottom surface side thereof toward the ink droplet eject port. The actuator is connected to the vibrating plate. By driving the actuator, the amount of displacement and a generation time of displacement during the excitation can be controlled.

In the present invention, the above-described space is dimensioned to facilitate the vibration of the beam-mounted vibrating plate. When the actuator is driven, the vibrating plate is efficiently deflected, and an instantaneous liquid flow toward the ink droplet eject port is generated in the ink droplet eject chamber.

By the conical shape of the inner portion of the chamber, the liquid flow provided by the vibrating plate causes a surface wave to be generated on a free surface of the ink at the periphery of the nozzle. The surface wave progress from the periphery of the nozzle to the center of the nozzle. The interference of the surface wave progressing centrally of an ink droplet eject port causes an ink droplet to be ejected at the center of the eject port. Thus, a much smaller ink droplet than the smallest diameter of the ink droplet eject port can be ejected drop by drop to a desired shot position.

In this case, unlike the prior art ink droplet eject apparatus using a pump principle, the diameter of the ink droplet eject port need not be especially small. It is possible to eject an ink droplet which is much smaller than the ink droplet eject port and ranges from a few $\mu$m to 20 $\mu$m in diameter, to a desired shot position drop by drop. The drive of the actuator is controlled so as to change a waveform and a wave height of the surface wave. Therefore, the diameter of the ink droplet can be easily varied. Thus, a density gradation recording can be realized.

Preferably, the drive area of the actuator connected to the vibrating plate is set to be larger than the diameter of the bottom of the ink droplet eject port of the ink droplet eject chamber.

In such a manner, during operation, the vibrating plate alone is efficiently deflected. The leakage of the liquid filled in the ink droplet eject chamber on the flow path side is suppressed. The liquid flow is efficiently generated from the bottom surface to the opening. The acoustic vibration from a vibrating plate is focused on an ink droplet eject chamber. The acoustic vibration is propagated to the ink droplet eject port. The surface wave is generated on the surface of an ink in the ink droplet eject port. The interference of the surface wave causes the ink droplet to be ejected. Therefore, a relatively small ink droplet can be ejected. When the vibrating plate is vibrated, no particular pressure is transmitted to a region except for the vibrated surface. Thus, ink does not at all flow back in the flow path. Accordingly, the tubular path area of the ink flow path can be set larger than in the prior art. In this respect, an inflow/outflow of the ink can be more smoothly performed. In the prior art, a volume shrinkage of the ink droplet eject chamber causes the ink droplet to be ejected. Thus, in order to prevent the back flow of the ink, for example, the ink flow path is throttled, and a loss of the volume shrinkage must be suppressed. On the other hand, in the present invention, the construction can be simplified.

The chamber space is dimensioned so that the central axis thereof may coincide with the central axis of the ink droplet eject port. The height and the width may be uniform.

In such a manner, when a residual bubble in the ink droplet eject chamber is removed, all of the ink in the ink droplet eject chamber can be removed. Since the flow rate of the liquid flowing in the ink flow path can be increased, conveniently, the bubble can be easily removed. In this case, the chamber space of the ink droplet eject chamber and the flow path can be formed in the same member. In this respect, production of the ink droplet eject apparatus can be improved.

Preferably, the ink flow path is disposed on at least two portions, that is, on a supply side of the ink to the ink droplet eject chamber and on an exit side for excess ink.

Thus, the ink flow is unidirectional. When the ink droplet eject chamber is filled with liquid, or when the residual bubble in the ink droplet eject chamber is removed, ink is sucked from the opening and the flow path on the liquid exit side. Therefore, the flow rate of the liquid flowing in the ink flow path can be increased. In this respect, workability can be improved, and a bubble can be easily removed.

More preferably, a plurality of ink droplet eject chambers are spaced from each other at a predetermined distance along row. Ink tank portions are disposed on both sides of the row of the ink droplet eject chambers. The ink flow path may be independently disposed in each of the ink droplet eject chambers.

Thus, if the number of ink droplet eject ports and ink droplet eject chambers is increased, during the filling with the ink and the removal of the residual bubble in the ink droplet eject chamber, the operation can be rapidly accomplished under the same conditions.

A plurality of ink droplet eject chambers are spaced from each other at a predetermined distance along a row. The ink tank portion is disposed on one end in a longitudinal direction of the row of the ink droplet eject chambers. The chamber spaces on the periphery of the bottom surface of each ink droplet eject chamber are connected to each other through the ink flow path having a predetermined width.

Thus, it is not necessary to arrange the flow path for supplying the liquid to each ink droplet eject chamber. The construction is so simple that the flow path passes through a plurality of ink droplet eject chambers. A miniaturization of the ink droplet eject apparatus and an improvement of its production can thus be achieved.

In this case, a suction port for sucking the ink may be disposed on the other end in the longitudinal direction of the row of the ink droplet eject chambers.

Thus, the construction is so simple that the flow path passes through a plurality of ink droplet eject chambers. When the ink droplet eject chamber is filled with liquid, or when the residual bubble is removed, two operations are performed. That is, one operation is that the liquid is sucked from the suction port with the ink droplet exit port closed. The other operation is that the liquid is sucked from the ink droplet exit port with the suction port closed. Thus, the flow rate of the liquid flowing in the flow path can be increased. Bubbles can be easily removed, while miniaturization can be achieved.

A circular or polygonal annular member may be disposed in a boundary region between the ink droplet eject chamber and the chamber space. The height of the annular member is less than the thickness of the chamber space.

Thus, when the actuator is driven, the leakage of liquid filled in the ink droplet eject chamber on the flow path side is suppressed. The liquid flow can also be efficiently generated from the bottom surface of the ink droplet eject chamber to the ink droplet eject port.

The annular member may be disposed on the side of the eject chamber forming member or the vibrating plate on the periphery of the bottom surface of the ink droplet eject chamber.

BRIEF DESCRIPTION OF THE DRAWINGS

FIG. 22(A) is a schematic perspective view of a third example of prior art, which ejects the ink droplet in a mist state by the interference of the surface wave.

FIG. 22(B) shows an operation of FIG. 22(A).

DETAILED DESCRIPTION OF PREFERRED EMBODIMENTS

Embodiments of the present invention will be described below with reference to the accompanying drawings.

Figure 1A:
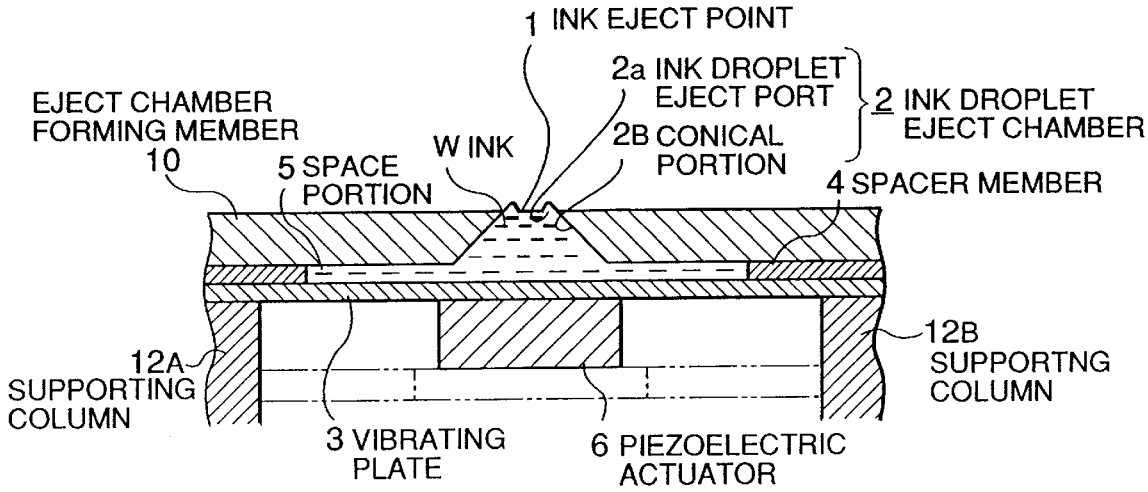
FIGS. 1(A) is a sectional partially schematic view of a first embodiment of the present invention, showing an ink droplet eject apparatus at a portion not including an ink flow path.
Figure 1B:
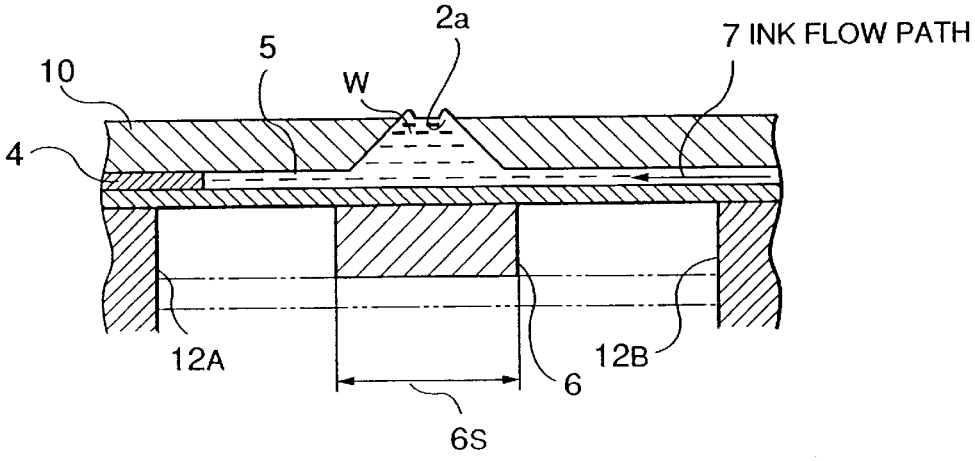
FIG. 1(B) is a view similar to FIG. 1(A), showing the ink droplet eject apparatus at a portion including the ink flow path.

In the first place, in FIGS. 1 through 3, an ink droplet eject apparatus comprises a plate-shaped member 10 defining part of an eject chamber. The member 10 includes an ink droplet eject chamber 2 having an ink droplet eject port 2*a* on one surface and a conical section 2*b*. The ink droplet eject apparatus further comprises a vibrating plate 3 which is spaced a predetermined distance from the flat interior surface of the member 10. The vibrating plate 3 is located so as to underlie all of the ink droplet eject port 2*a*.

A spacer member 4 is disposed between the vibrating plate 3 and the member 10. Numerals 12A and 12B denote supporting columns which beam-support only peripheral portions of the vibrating plate 3.

An annular space 5 is surrounds the bottom surface region of the ink droplet eject chamber 2. The space 5 is defined by the vibrating plate 3, spacer A and the member 10. The space 5 communicates with the ink droplet eject chamber 2. The spacer member 4 has a predetermined thickness and surrounds the annular space portion 5.

Figure 2A:
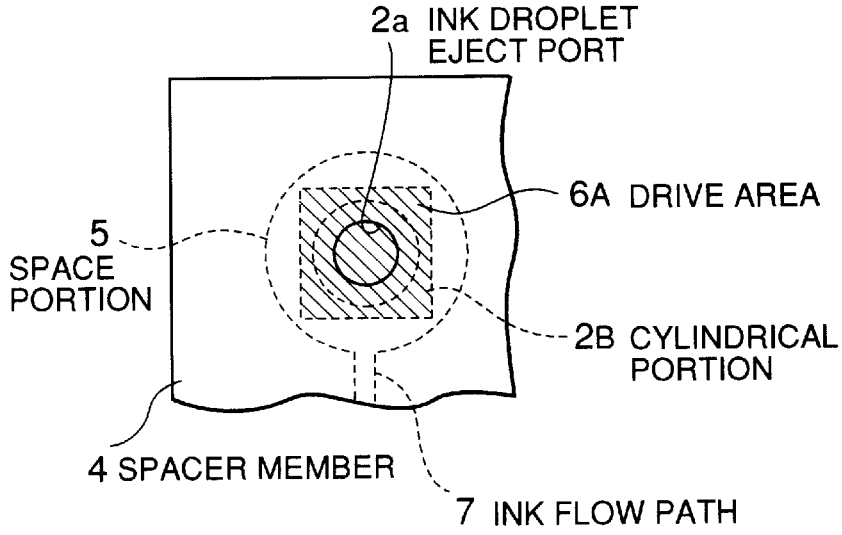
FIG. 2(A) is a schematic plan view of the circular space portion and drive surface of the first embodiment.
Figure 2B:
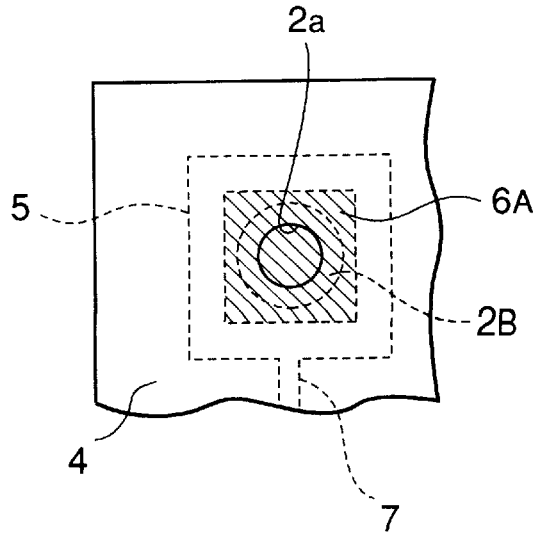
FIG. 2(B) is a schematic plan view of the rectangular space portion and drive surface of a fist embodiment.

The spacer member 4 is actually cut in a circular shape or a rectangular shape (or polygonal shape) as shown in FIGS. 2(A) and 2(B) so that it surrounds the bottom surface region of the ink droplet eject chamber 2 and the annular space 5.

A piezoelectric actuator 6 is connected to the vibrating plate 3. The piezoelectric actuator 6 excites the vibrating plate 3. The piezoelectric actuator 6 is controlled to generate an intermittent liquid flow of an ink W in the ink droplet eject chamber 2 so that the ink W may be directed toward the ink droplet eject port 2*a* from the bottom surface side of the ink droplet eject chamber 2. The piezoelectric actuator 6 can control as desired the amount of displacement and generation time of displacement during an excitation.

A drive area 6A of the piezoelectric actuator 6 connected to the vibrating plate 3 is set to be larger than the diameter of the bottom of the ink droplet eject port 2*a*. This facilitates the generation of an instantaneous liquid flow ink W in the ink droplet eject chamber 2.

Figure 10:
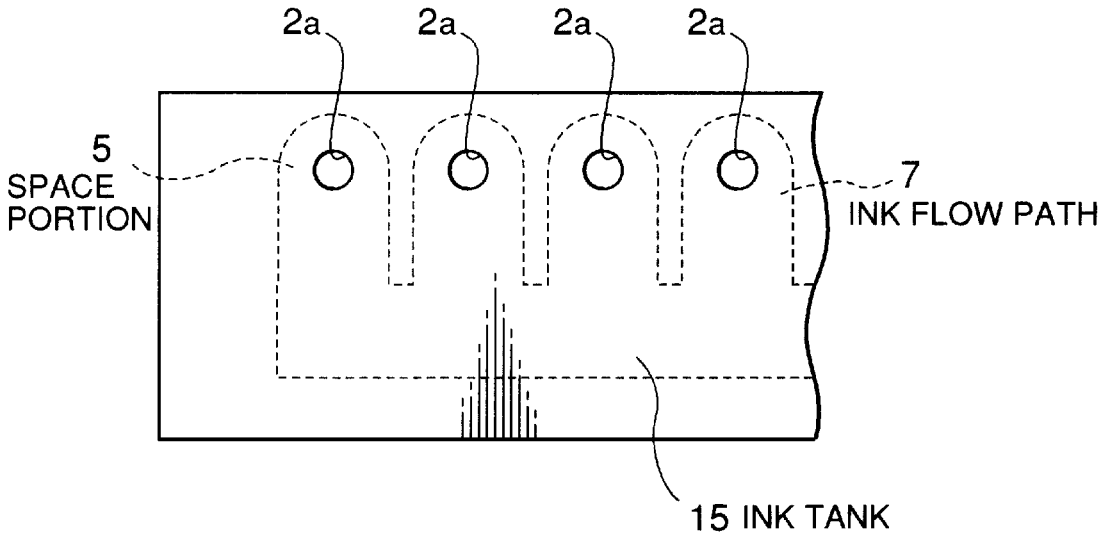
FIG. 10 shows a second embodiment, showing the relationship among the ink droplet eject ports, the space portion and the ink tank when a plurality of ink droplet eject apparatuses are arranged on the same line.

An ink flow path 7 is coupled to the ink droplet eject chamber 2. The ink flow path 7 comprises an area of a path surface (an area of a tubular path in the direction perpendicular to the eject direction of the ink W). As shown in FIG. 2, the cross-sectional area of the tubular path is set smaller than the area of the ink droplet eject port 2*a*. On the other hand, the area of the tubular path of the ink flow path 7 may be set larger as shown in FIG. 10 by appropriately reducing a drive time of the piezoelectric actuator 6 as described below.

The annular space 5 is disposed between the ink flow path 7 and the ink droplet eject chamber 2. The space 5 is open to the ink droplet eject chamber 2 on the inner side thereof. The annular space 5 is set by the spacer member 4 so that the center point thereof coincides with that of the ink droplet eject port 2*a*. The annular space 5 also has constant height and width. This permits the stable and reproducible generation of the liquid flow.

Figure 3A:
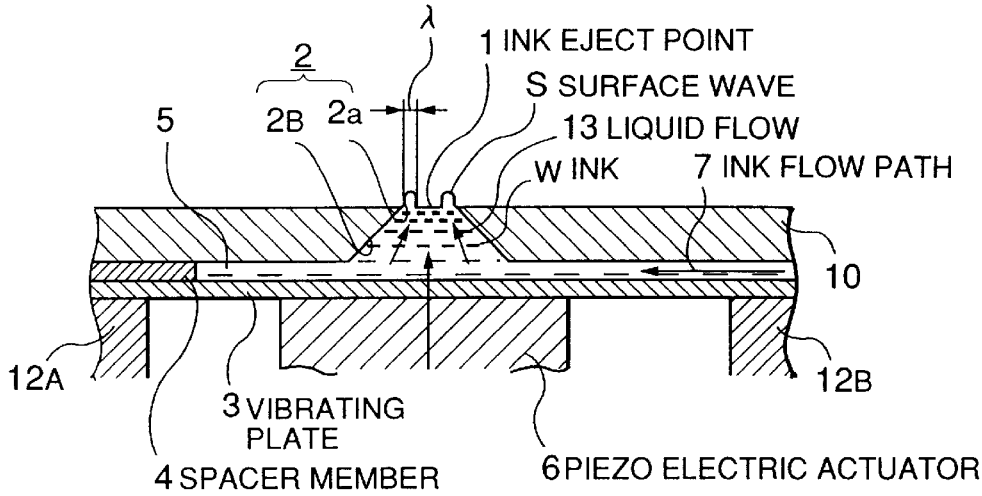
FIG. 3(A) shows generation of a surface wave in an eject process of an ink droplet, in the first embodiment.
Figure 3B:
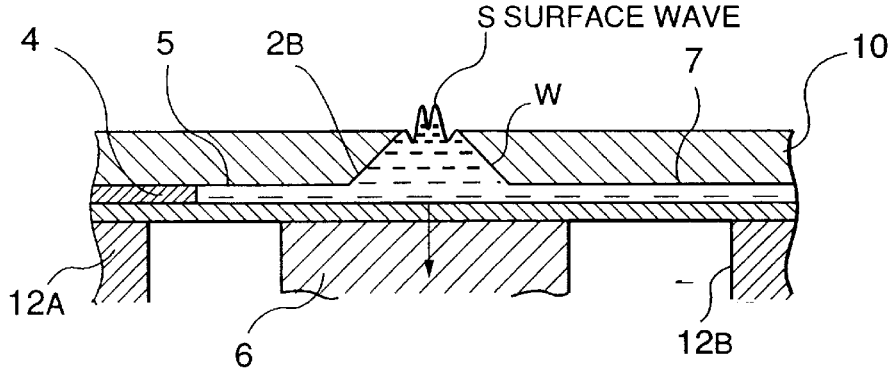
FIG. 3(B) shows a progression of the surface wave of FIG. 3(A).

Reference character S in FIG. 3(B) denotes a surface wave. The surface wave is excited by the vibrating plate 3 so as to be generated. The surface wave progresses in the direction of an ink droplet eject point 1 on the free surface of the ink W.

Furthermore, as shown in FIG. 3(A), the actuator 6 is driven so that an ink flow 13 of the liquid ink W filled in the ink droplet eject chamber 2 is instantaneously generated in the direction of the ink droplet eject port 2*a* from the bottom surface. An operation of the ink flow 13 generates the circular surface wave S on the free surface of the ink W. The surface wave S progresses in the direction of the ink droplet eject point 1 from positions which are substantially equally spaced from the ink droplet eject point 1.

Figure 3C:
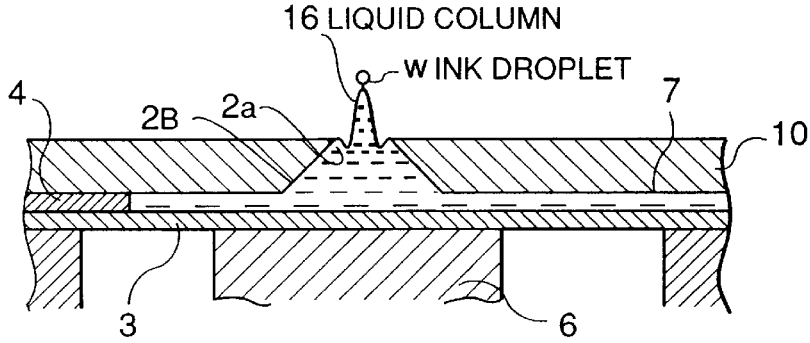
FIG. 3(C) shows ejection of the ink droplet caused by a generation of a liquid column due to an interference of the surface waves of FIGS. 3(A) and 3(B).

The phase behavior of surface waves S gradually results in interference. As shown in FIG. 3(B), as the surface wave S progresses in the direction of the ink droplet eject point 1, the wave height is increased. As a result, a liquid column 16 is formed near the ink droplet eject point 1 as shown in FIG. 3(C). The wave height is maximum at the ink droplet eject point 1. An ink droplet w is separated from the edge of the liquid column 16 so as to be ejected. The diameter of the ejected ink droplet w is changed in proportion to the diameter of the liquid column 16 just prior to the ejecting of the ink. The diameter of the liquid column 16 is also changed in substantial proportion to a wavelength of the surface wave S.

The wavelength of the surface wave S is defined as X, as shown in FIG. 3(A). Whether or not the ink droplet w is ejected depends on the height of the liquid column 16 (that is, the height of the surface wave S). Therefore, the height of the surface wave S is changed so that the ejecting of the ink droplet w is controllable. Thus, a vibration output of the piezoelectric actuator 6 is controlled to a predetermined value to establish whether or not the ink droplet w is ejected.

Furthermore, the diameter of the ink droplet w does not depend on the size of the ink droplet eject port 2*a*. The inventors have been able to experimentally confirm that the diameter is varied in accordance with the wavelength of the surface wave S.

The vibrating plate 3 is beam-supported by 12A and 12B. That is as shown in FIG. 2, the drive area 6A of the piezoelectric actuator 6 is larger than the opening diameter of the bottom surface of conical portion 2B, yet is smaller than the area bounded by the inner diameter (diameter) of the spacer member 4. When the actuator 6 is driven, the vibrating plate 3 alone is efficiently deflected. At the same time, the ink flow 13 can be effectively generated without the leakage of the ink W in the ink flow path 7.

The surface wave S described above will now be described in further detail.

As shown in FIG. 3(A), the conical portion 2B directs an intermittent liquid flow 13 toward the ink droplet eject port 2*a* from the bottom surface side of the ink droplet eject chamber 2. Thus, the surface wave S can be formed.

When the liquid flow 13 is directed from the bottom surface side to the top surface side of the ink droplet eject chamber 2, as the liquid flow 13 approaches the surface, the diameter of the ink droplet eject port 2*a* is reduced. Therefore, a pressure is increased near a wall surface of the conical portion 2B. A flow rate is also increased near the wall surface. The surface wave S is thus generated on the free surface of the ink W in accordance with the shape of the ink droplet eject port 2*a*.

When a circular ink droplet eject port 2*a* is used, a circular surface wave can be formed; however, polygonal eject ports 2*a* are also envisioned.

The wavelength $\lambda$ of the generated surface wave S can be controlled at will mainly by changing the generation time of the liquid flow 13 as described above. The wave height of the generated surface wave S can be controlled mainly by changing the flow rate of the liquid flow 13.

In a first embodiment, the liquid flow 13 is defined as both the flow of the uncompressed ink W and the flow of an elastic wave caused by the compression of the ink W. When the surface wave S is formed in a circular shape, a rate of amplification of the wave height resulting from interference is maximum. When the surface wave S interferes completely in phase while progressing in the direction of the ink droplet eject point 1, the ink droplet w can be most efficiently and stably ejected.

Figure 5:
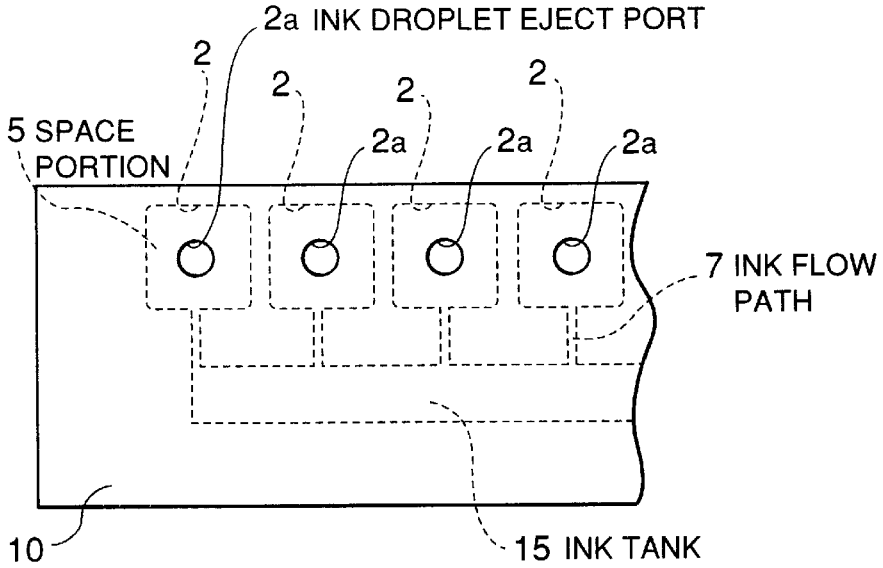
FIG. 5 shows a plurality of ink droplet eject apparatuses of FIG. 1, showing a positional relationship between an ink droplet eject port and an ink tank.
Figure 11:
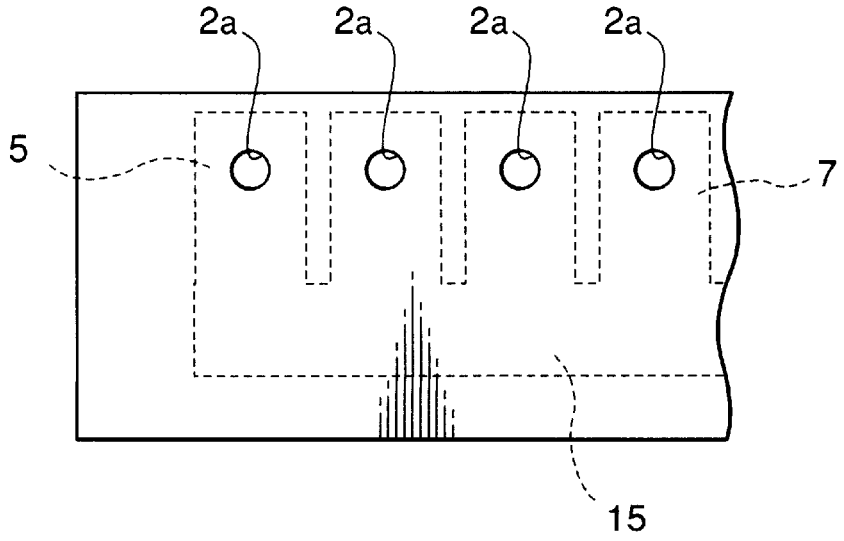
FIG. 11 shows a variation of the second embodiment shown in FIG. 10.
Figure 12:
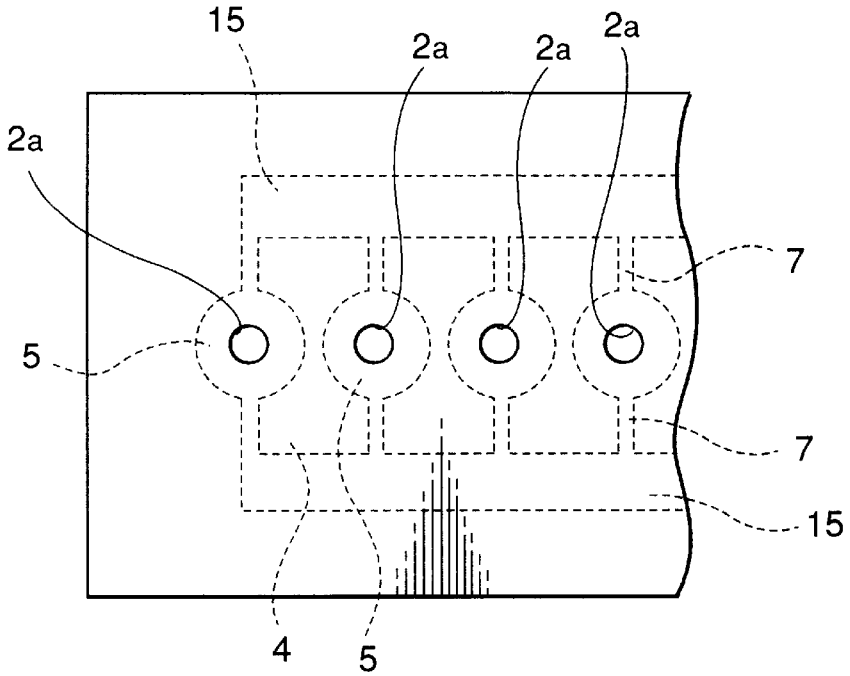
FIG. 12 shows a third embodiment, showing the relationship among the ink droplet eject ports, the space portion and the ink tanks in two rows when a plurality of ink droplet eject apparatuses are arranged on the same line.
Figure 13:
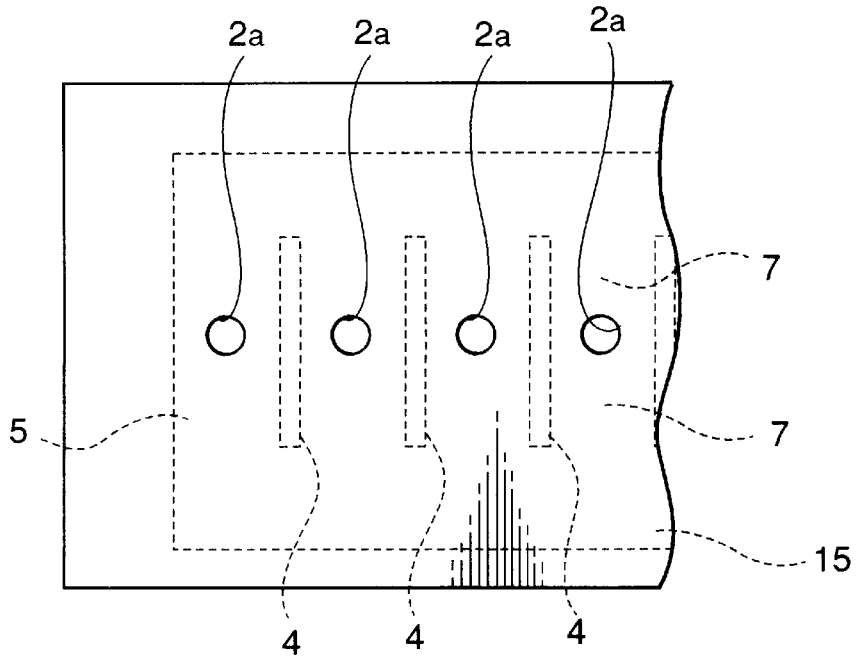
FIG. 13 shows the variation (when a tubular path area of the ink flow path is changed) of the third embodiment shown in FIG. 12.

As shown in FIGS. 5, 10 and 11, each ink flow path 7 may communicate with ink tank portions 15 located on the side surfaces. As shown in FIGS. 12 and 13, each pair of flow paths 7 (at least two paths including, for example, one path for supplying the ink W to the ink droplet eject chamber 2 and the other path for discharging an excess of the ink W) may lead to ink tank portions 15, 15 located on opposite sides.

That is, a plurality of ink droplet eject chambers 2 are spaced at predetermined intervals in the same column. An ink tank portion 15 is disposed on at least one side of the column of the ink droplet eject chambers 2 (see FIGS. 10 and 11). Each ink tank portion 15 is coupled to each ink droplet eject chamber 2 by the ink flow path 7 defined by spacer 4. The ink flow path 7 is independently disposed in each ink droplet eject chamber 2. In this case, one ink flow path 7 may be disposed per one ink droplet eject chamber 2.

Figure 14A:
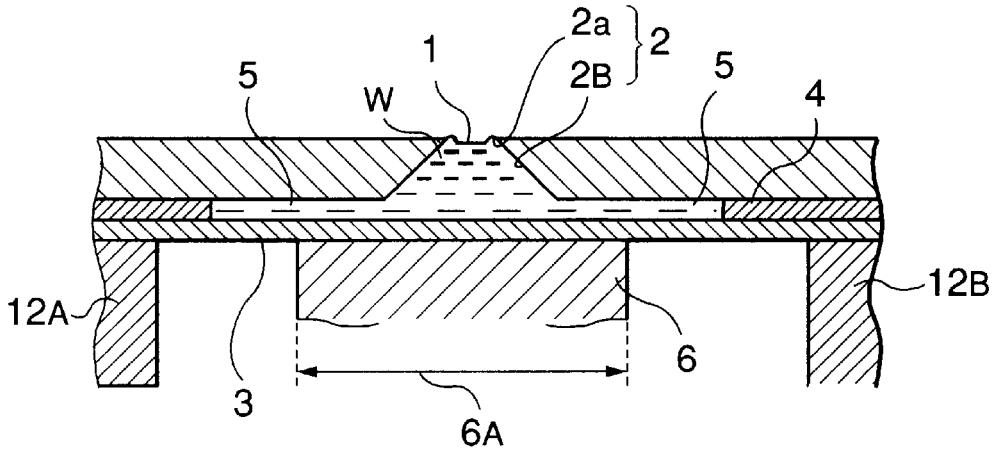
FIG. 14(A) is a longitudinal sectional partially schematic view of a fourth embodiment of the present invention, showing one ink droplet eject apparatus when a plurality of ink droplet eject apparatuses are arranged on the same line.
Figure 14B:
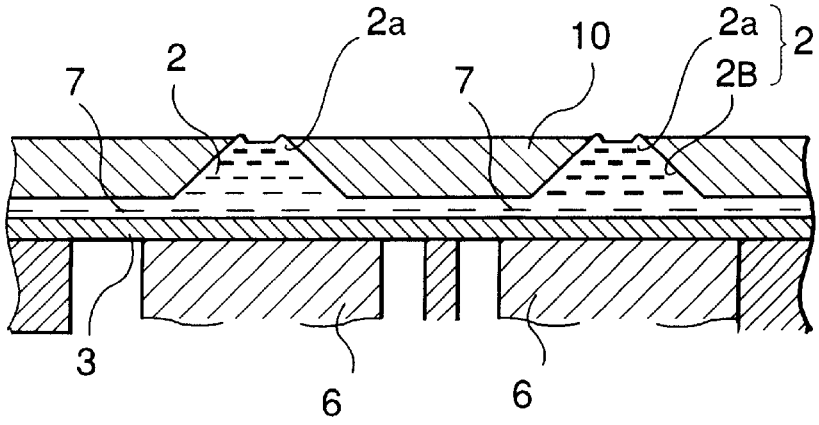
FIG. 14(B) is a longitudinal sectional partially schematic view of a fourth embodiment, including two ink droplet eject apparatuses.

A plurality of ink droplet eject chambers 2 are first spaced at predetermined intervals in the same column. The ink tank portions 15, 15 are preferably disposed on both sides of the column of the ink droplet eject chambers 2 (see FIGS. 12 and 13). Each ink tank portion 15 is coupled to each ink droplet eject chamber 2 through the spacer member 4 by the ink flow path 7. In this case, each ink flow path 7 is disposed on the right and left sides of each ink droplet eject chamber 2, that is, each ink droplet eject chamber 2 has in total two flow paths 7. In this case, since the flow of the ink W is unidirectional, the ink flow is smoother than the flow along one path. FIGS. 14(A) and 14(B) are longitudinal sectional views including the ink droplet eject chamber 2 of FIG. 12 as described below.

The ink flow path 7 may also be arranged as shown in FIGS. 15 to 18.

Figure 17:
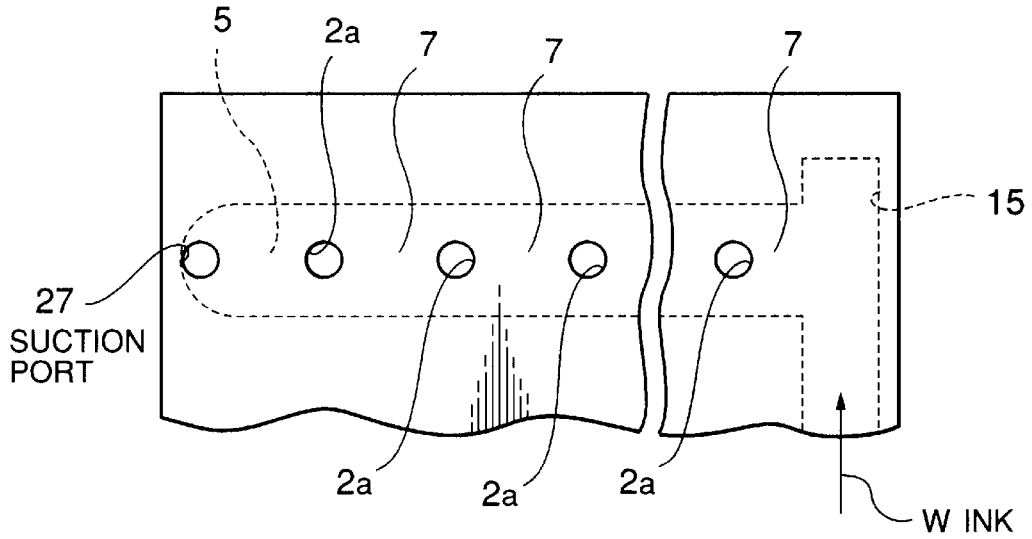
FIG. 17 shows a fifth embodiment, showing the relationship among the ink droplet eject ports, the space portion and the ink tank when a plurality of ink droplet eject apparatuses are arranged on the same line.
Figure 18:
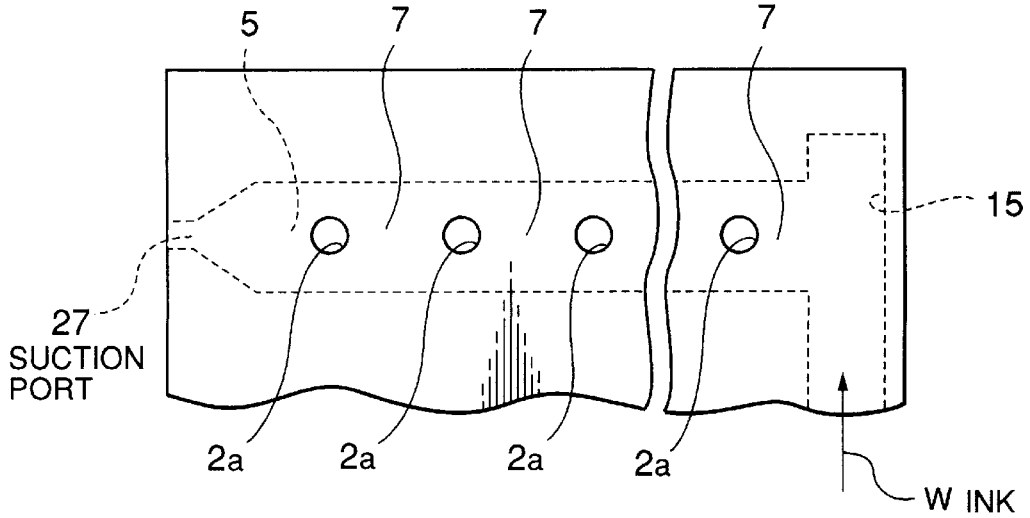
FIG. 18 shows the variation (when the tubular path area of the ink flow path is changed) of the fifth embodiment shown in FIG. 17.

That is, a plurality of ink droplet eject chambers 2 are spaced at predetermined intervals in the same column. The ink tank portion 15 is disposed on one end in a longitudinal direction of the column of the ink droplet eject chambers 2. The space 5 around the bottom surface portion of each ink droplet eject chambers 2 is connected to each other through the ink flow path 7 having a predetermined width. In this case, as shown in FIGS. 17 and 18, an ink suction port 27 sucking the ink W may be disposed on the other end of the longitudinal direction of the column of the ink droplet eject chambers 2.

In such a manner, the ink tank portion 15 adjoins the region of each ink droplet eject chamber 2. Accordingly, an ink jet type print head portion can be greatly miniaturized. When the ink suction port 27 is disposed, conveniently, the ink flow can be further smoothed in spite of the miniaturization.

Figure 19A:
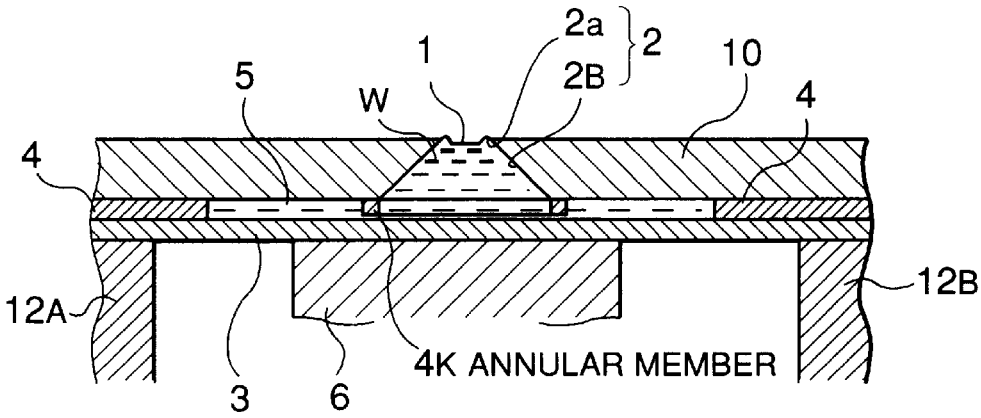
FIG. 19(A) is a longitudinal sectional view of a sixth embodiment.
Figure 19B:
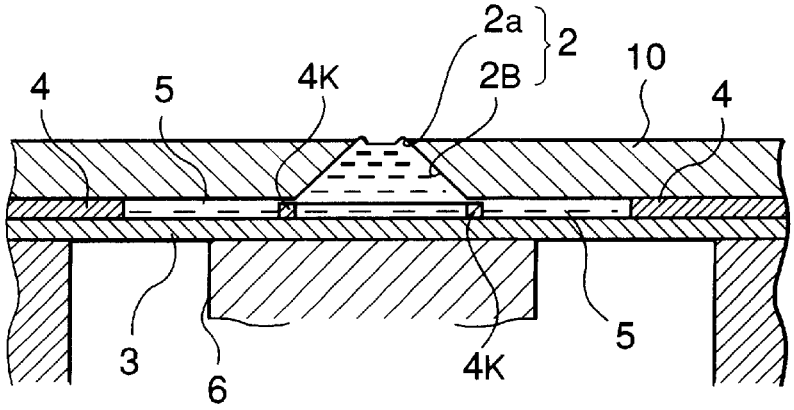
FIG. 19(B) is a longitudinal sectional view showing the variation of FIG. 19(A).
Figure 20A:
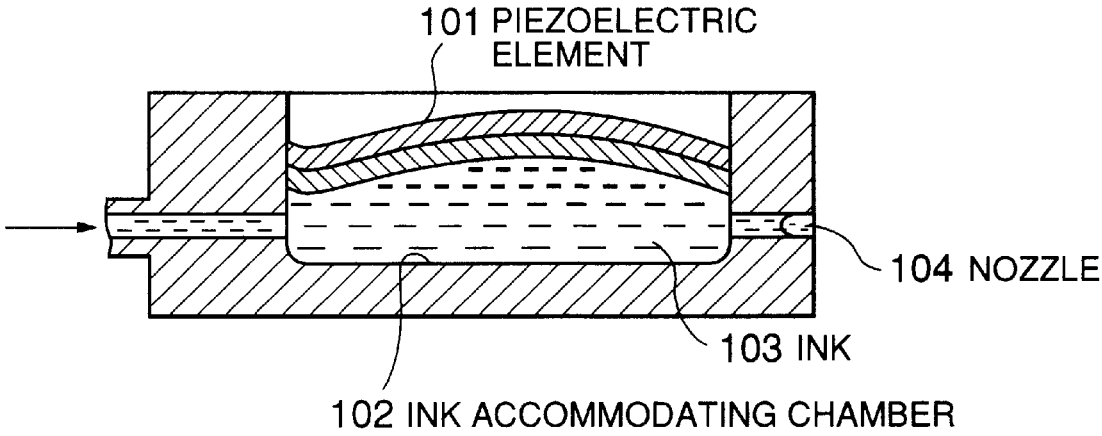
Fig.20(A) PRIOR ART
FIG. 20(A) shows a normal state of the first example of prior art using a pumping principle.
Figure 20B:
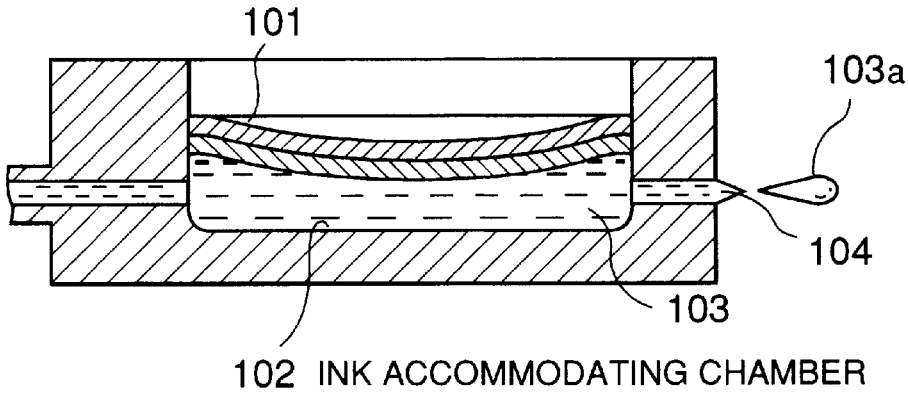
Fig.20(B) PRIOR ART
FIG. 20(B) shows the state just after the ejection of the ink droplet of the first example.
Figure 21:
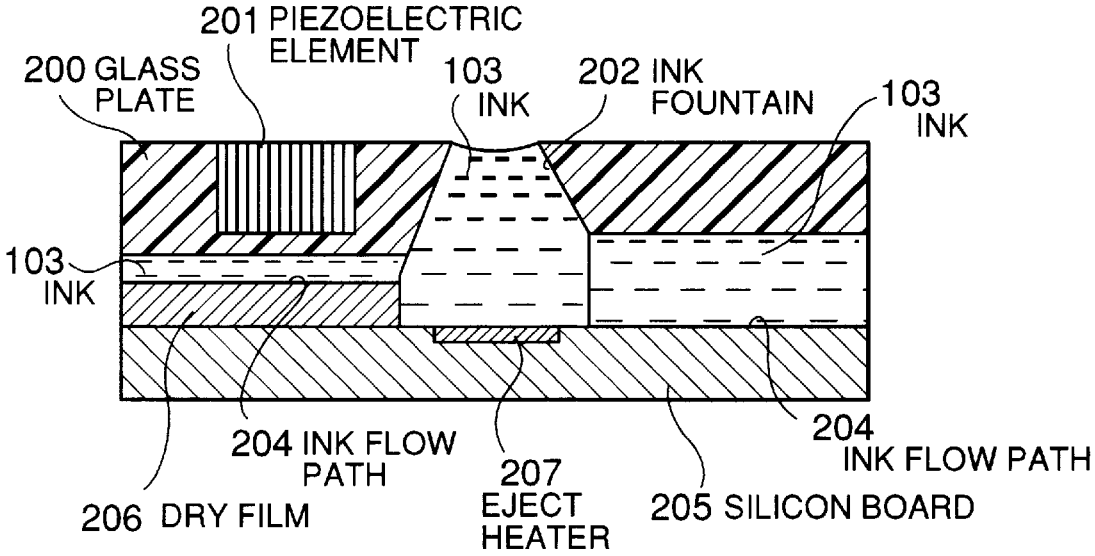
Fig.21 PRIOR ART
FIG. 21 shows a second example of prior art, in which different inks are mixed in an ink fountain, and the pump principle is used to eject the ink droplet.
Figure 23:
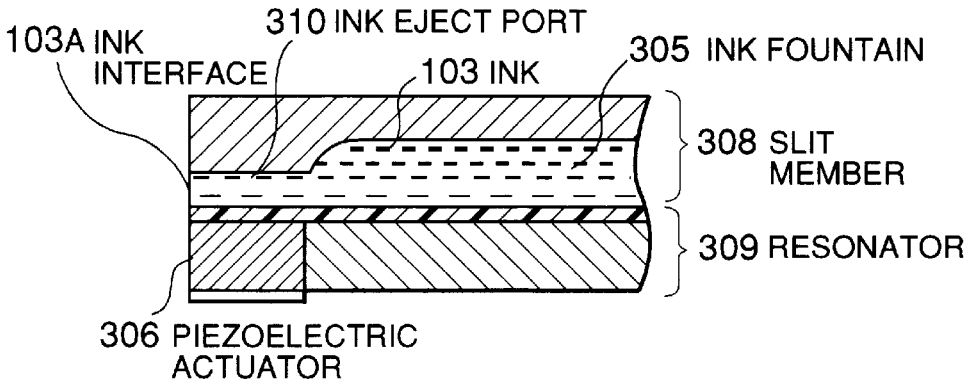
Fig.23 PRIOR ART
FIG. 23 shows the fourth example of prior art, being a schematic cross sectional view showing the apparatus which ejects the ink droplet in the mist state by the interference of the surface wave.
Figure 24:
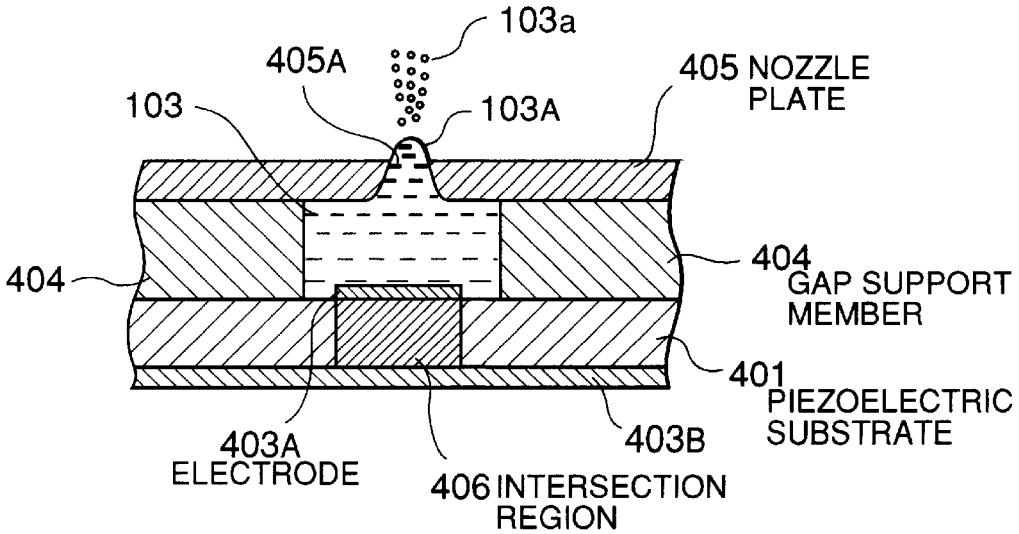
Fig.24 PRIOR ART
FIG. 24 shows the fifth example of prior art, being a schematic cross sectional view showing the apparatus which ejects the ink droplet in the mist state by the interference of the surface wave.
Figure 25:
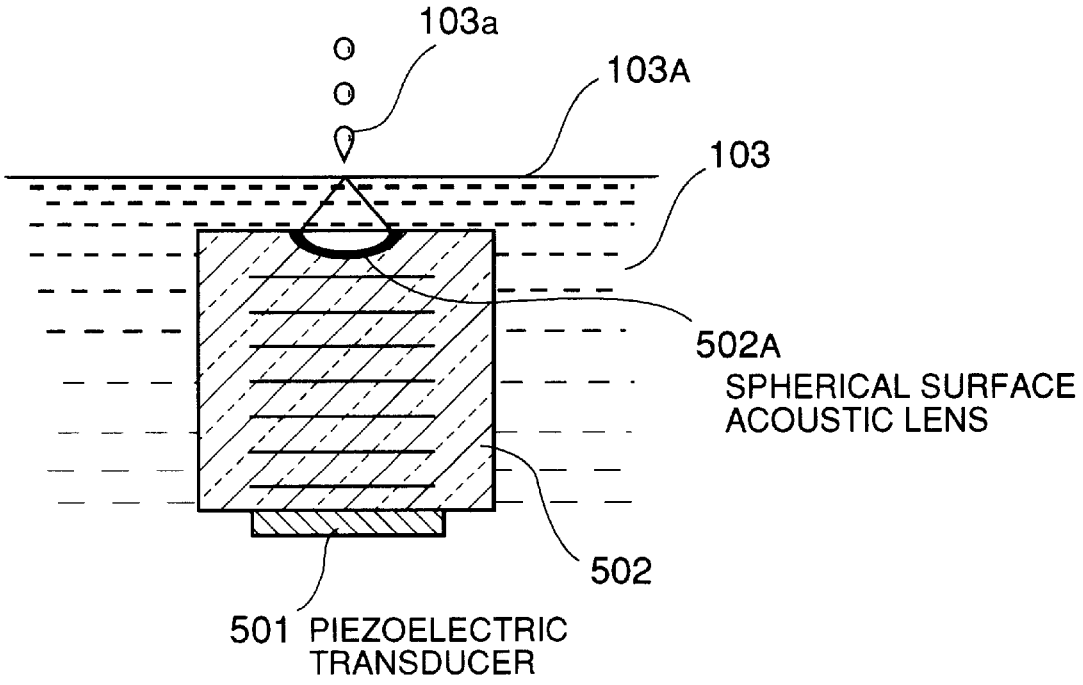
Fig.25 PRIOR ART
FIG. 25 shows the sixth example of prior art, being a schematic cross sectional view showing the apparatus which ejects the ink droplet by the use of a radiation pressure of an ultrasonic wave.
Figure 26A:
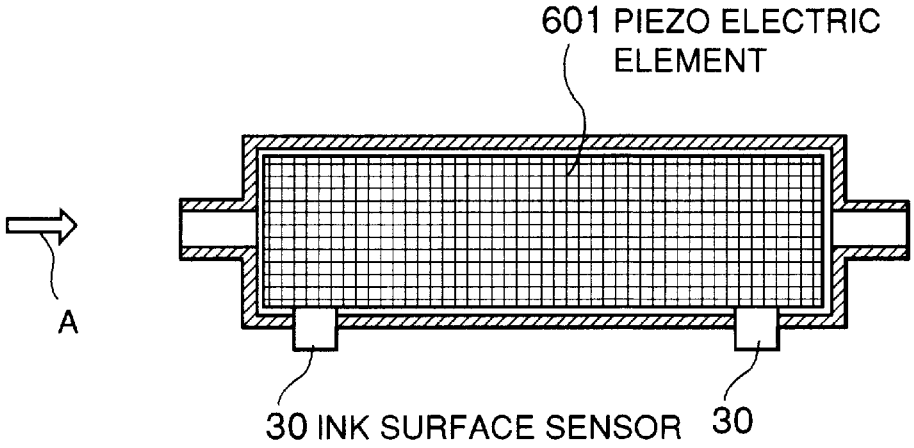
Fig.26(A) PRIOR ART
FIG. 26(A) is a schematic plan view of the seventh example of prior art, showing the ink droplet eject apparatus which ejects ink droplets from a desired position by focusing a pressure wave.
Figure 26B:
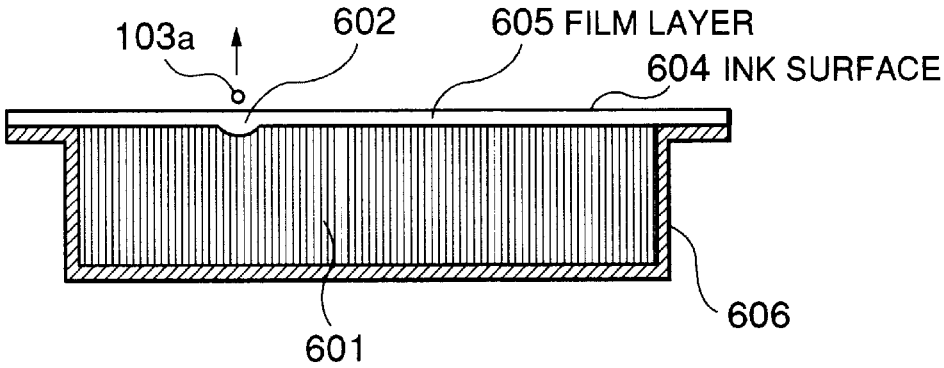
Fig.26(B) PRIOR ART
FIG. 26(B) is a schematic longitudinal sectional view of FIG. 26(A).

In FIGS. 19(A) and 19(B), an annular member 4K is disposed in circular shape or polygonal shape in a boundary region between the annular space 5 and the ink droplet eject chamber 2. The height of the annular member 4K is smaller than the thickness of the space 5. In this case, in FIG. 19 (A), the annular member 4K is disposed on the member 10 around the bottom surface of the ink droplet eject chamber 2. In FIG. 19(B), the annular member 4K is disposed on the vibrating plate 3 in the boundary region between the annular space 5 and the ink droplet eject chamber 2.

In either case, it is possible to effectively prevent the outward escape of the vibration energy of the vibrating plate 3 which is output into the ink droplet eject chamber 2. In this respect, a capacitor valve of the piezoelectric actuator 6 can be reduced, which allows further miniaturization of the whole apparatus and reduction of cost.

More particular structural details will now be described.

In FIGS. 1(A) to 3, the ink W is supplied to the ink droplet eject chamber 2 from an ink tank (not shown) through an ink flow path 7 which is 40 $\mu$m in diameter. The length of the flow direction of the ink W in the ink flow path 7 is about 100 $\mu$m.

The vibrating plate 3 is made of metal and is 8 to 15 $\mu$m, preferably 10 $\mu$m, in thickness. If the vibrating plate 3 is too thick, the ink droplet eject chamber 2 becomes deformed when piezoelectric actuator 6 is driven. If the vibrating plate 3 is too thin, regions not bonded to the piezoelectric actuator 6 become deformed when the piezoelectric actuator 6 is driven, and the efficiency decreases.

The ink droplet eject port 2*a* is preferably a circle of about 100 $\mu$m in diameter. The dimension on the bottom of the conical portion 2B is about 300 $\mu$m in diameter.

Furthermore, a spacer member 4 of about 40 $\mu$m thickness is put between plate 10 and the vibrating plate 3.

As shown in FIG. 2(A), the space 5 may be circular, in which case its diameter is about 360 $\mu$m. Alternatively, as shown in FIG. 2(B), the space 5 may be a square whose sides are about 360 $\mu$m. The drive area 6A of the piezoelectric actuator 6 connected to the vibrating plate 3 is preferably a square whose sides are about 320 $\mu$m in FIG. 2(A). The bottom of conical portion 2B is about 300 $\mu$m in diameter in this case.

The drive area 6A is larger than the base of conical portion 2B, preferably 1.2 to 1.5 times larger. However, if the area is too great, the pitch of ink droplet eject ports increases, and the printing head must be made larger.

The vibrating plate 3 is beam-supported, in that columns 12A and 12B leave exposed substantial portions of plate 3 underlying the annular space 5 and surrounding actuator 6. In addition, the inner surface of conical portion 2B is preferably smooth and continuous. It is of possible to change the inclination and length of portion 2B so long as the surface wave S shown in FIG. 3(A) is formed on the free surface of the ink W.

Next, in order to investigate ink droplet eject characteristics of the ink droplet eject apparatus of the first embodiment, the piezoelectric actuator 6 is provided with a displacement of a cosine curved time response in which a time amplitude is 10 $\mu$s and a displacement amplitude is 0.4 $\mu$m. It is preferred that the waveform applied on the piezoelectric actuator 6 has a small high frequency component, for example, a cosine curve as mentioned above because intermittent liquid flow 13 become stable.

In this example, when the piezoelectric actuator 6 is driven, the vibrating plate 3 alone is efficiently deflected. A liquid flow 13 of the ink W filled in the ink droplet eject chamber 2 can be generated from the bottom surface to the ink droplet eject port 2*a*. An operation of the liquid flow 13 allows a surface wave S to be efficiently generated.

As a result, it is possible to confirm that an ink droplet w of about 30 $\mu$m in diameter is stably ejected from an ink droplet eject point 1 at the center of the ink droplet eject port 2*a*, whose smallest diameter is about 100 $\mu$m.

The eject process of the ink droplet w has been observed with a stroboscope. The piezoelectric actuator 6 is driven so as to provide the displacement for the vibrating plate 3. In the first place, as shown in FIG. 3(A), the circular surface wave S has been observed to be formed.

As shown in FIG. 3(B), the circular surface wave S progresses toward the ink droplet eject point 1 while the wave height thereof is gradually amplified. As shown in FIG. 3(C), a liquid column 16 is formed near the ink droplet eject point 1. Just after that, the ink droplet w of about 30 μm in diameter is separated so as to be ejected upward.

Next, the piezoelectric actuator 6 is provided with three displacements of cosine curved time response having time amplitudes of 20 μs, 5 μs and 3 μs and displacement amplitudes of 0.5 μm, 0.3 μm and 0.2 μm, respectively. Ink droplets w of about 36 μm, 15 μm and 7 μm in diameter are ejected from the ink droplet eject point 1 of the ink droplet eject port 2*a*, respectively.

Thus, it is possible to eject, drop by drop, ink droplets w much smaller than the ink droplet eject port 2*a*. The diameter of the ink droplet w can be varied in accordance with the drive time of the piezoelectric actuator 6. The change in the drive time and the amount of displacement of the piezoelectric actuator 6 corresponds to the change in the time generating the flow rate and liquid flow 13. Thus, the generation time of the flow rate and liquid flow 13 is controlled, thereby allowing the ink droplet w to be freely controlled. A density gradation recording can thus be realized.

For a comparison, the ink droplet eject chamber 2 is used without the annular space 5, by removing spacer 4, and the above displacement is provided for the piezoelectric actuator 6. In this case, as the displacement time amplitude of the piezoelectric actuator 6 is shorter, not only the vibrating plate 3 but also the whole ink droplet eject chamber 2 are considerably deformed. The eject of the ink droplet w cannot be performed.

Figure 4:
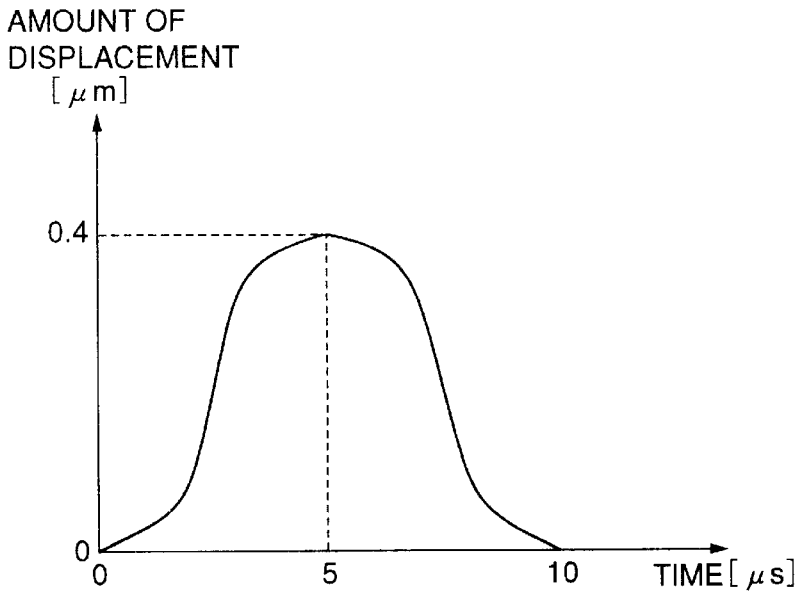
FIG. 4 is a graph showing a drive waveform of a piezoelectric actuator of the ink droplet eject apparatus of FIG. 1.

In the first embodiment, the drive of the piezoelectric actuator 6 is defined as the displacement of the cosine curved time response shown in FIG. 4. On the other hand, even in the case of, for example, a triangular waveform, a trapezoid waveform or a waveform of the combination thereof, if the surface wave S shown in FIG. 3(A) is formed on the free surface of the ink W, as is the case with the above embodiment, the ink droplet w can be ejected with a diameter smaller than the ink droplet eject port 2*a*.

Furthermore, in the first embodiment, the dimension of the annular space is a square whose side is 360 μm. A drive area 19 of the piezoelectric actuator 6 connected to the vibrating plate 3 is a square whose side is 320 μm. On the other hand, as shown in FIG. 2(A), the annular space 5 may be circular. Even in this case, if the drive area 19 is larger than the base of conical portion 2B and is smaller than the annular space, the ink droplet w can be ejected in diameter smaller than the ink droplet eject port 2*a*.

The ink droplet eject apparatus is so constructed that the drive area 19 of the piezoelectric actuator 6 may be a square whose side is 200 μm and may be smaller than the base of conical portion 2B. Such an ink droplet eject apparatus is used so as to carry out an eject test of the ink droplet w as described above.

As a result, for example, when the time amplitude is 10 μs, the displacement amplitude is 0.6 μm in order to eject the ink droplet w of 30 μm in diameter. The displacement amplitude necessary for the ejecting is increased by about 50%.

When the time amplitude is 5 μs, the displacement amplitude of the piezoelectric actuator 6 is 0.5 μm necessary for ejecting an ink droplet w of 15 μm in diameter. On the other hand, when the time amplitude is 3 μs, a fine ink droplet w of 8 μm in diameter cannot be formed regardless of the displacement amplitude.

The drive area 19 of the piezoelectric actuator 6 is larger than the base of conical portion 2B and smaller than the annular space 5. This suppresses the leakage of the ink W in the ink flow path 7, such that good ejecting of the ink droplet w can be achieved.

Next, when the above-described ink droplet eject apparatus is applied to an ink jet printing head, a print experiment is carried out. This will be described below.

Figure 6:
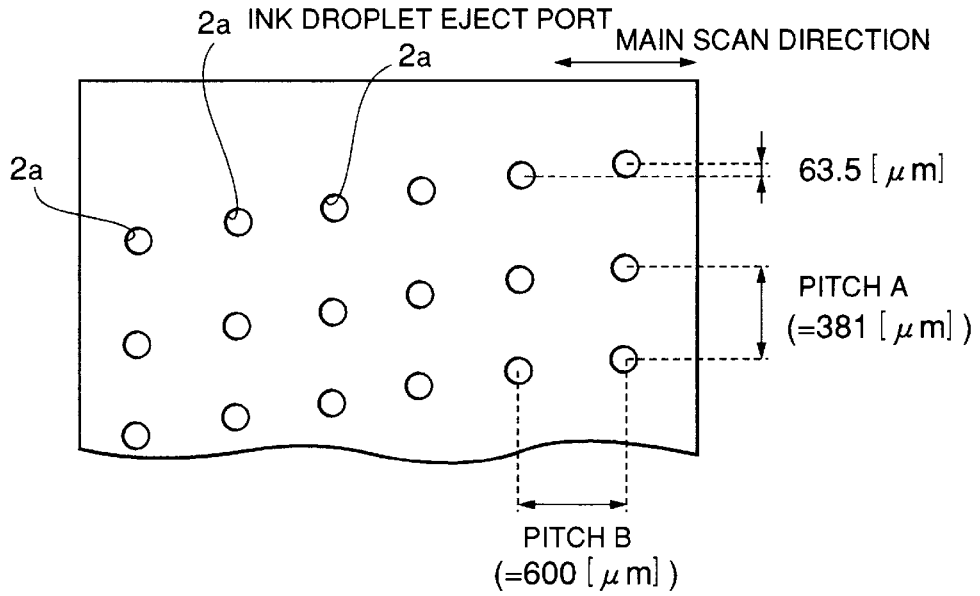
FIG. 6 shows an arrangement of a plurality of ink droplet eject ports.

Printing head 22 has a plurality of ink droplet eject ports 2*a* as shown for example in FIGS. 5 and 6. The printing head 22 is fixed to a carriage 23 so that the ink droplet eject ports 2*a* face a platen 21 through a printing paper 20.

The ink droplet eject chamber 2 for ejecting the ink droplet w is provided with the ink flow path 7 for each ink droplet eject chamber 2 as shown in FIG. 5. The ink W is supplied from the ink tank 15. As shown in FIG. 6, the ink droplet eject ports 2*a* are arranged so that a pitch A between the ink droplet eject ports 2*a* is 381 μm.

The group of 21 ink droplet eject ports 2*a* is arranged in six columns in a staggered pattern. The printing head 22 is produced so that 126 (i.e., 6×21) ink droplet eject ports 2*a* may be arranged in total.

A pitch B between the ink droplet eject ports 2*a* should be 600 μm in the direction of a main scan, since the ink flow path 7 is disposed for each ink droplet eject chamber 2.

Figure 8:
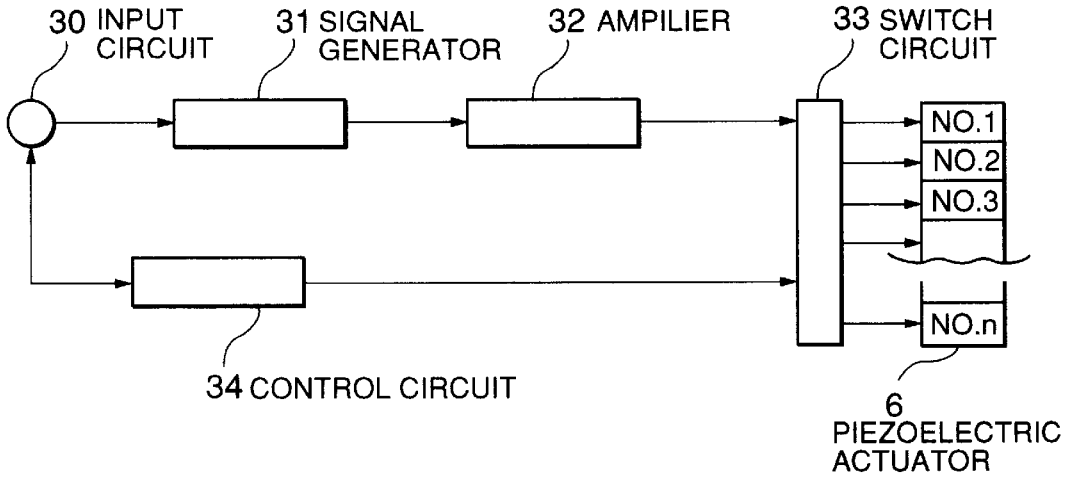
FIG. 8 is a block diagram of the piezoelectric drive for an ink jet printing apparatus according to the present invention.

Each ink droplet eject apparatus is so constructed that the switch circuit 33 of FIG. 8 can independently control each piezoelectric actuator 6 in accordance with an electrical printing signal inputted to the input circuit 30, as also shown in FIG. 8. The waveform signal is generated in the signal generator 31 and amplified by the amplifier 32. The signal having the waveform, the pulse width, and the amplitude according to an electrical printing signal is applied to the determined piezoelectric actuator 6 via the switch circuit 33.

Figure 7:
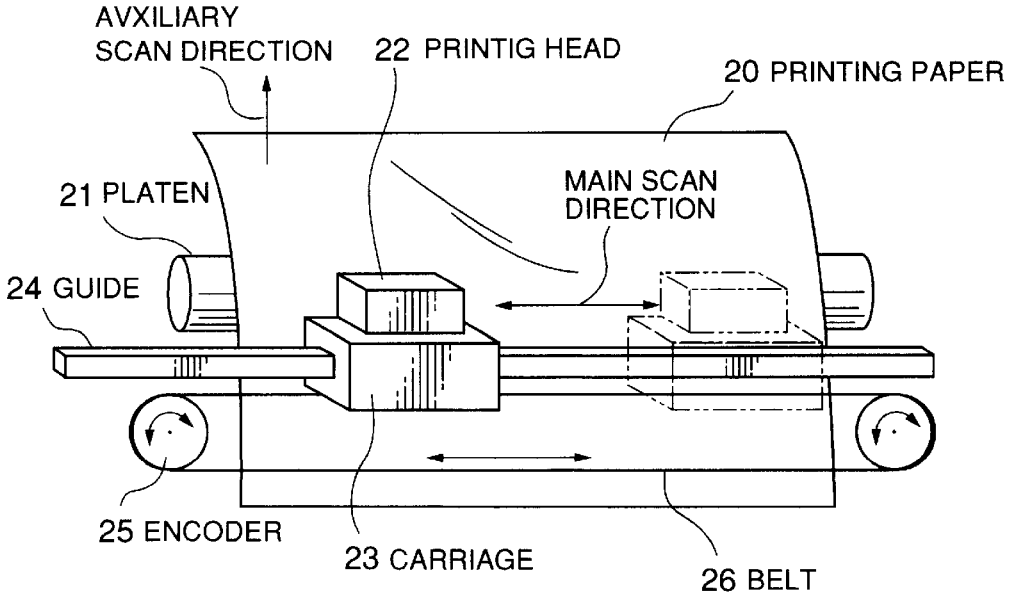
FIG. 7 is a schematic perspective view showing an example of an ink jet printing apparatus mounting the ink droplet eject apparatus according to the present invention.

In the print experiment, in the first place, as shown in FIG. 7, the printing head 22 is fixed to the carriage 23. The carriage 23 is disposed so that it can scan in an axial direction of the platen 21 by a guide 24. A main scan is performed by an encoder 25 and a belt 26.

Furthermore, the 126 ink droplet eject apparatuses control the eject timing of the ink droplet w for each scan of 63.5 μm in the main scan direction in response to the presence or absence of an image signal. The drive time amplitude and displacement amplitude of the piezoelectric actuator 6 are changed for each pixel. The diameter (droplet diameter) of the ink droplet w is modulated, while printing is performed. The pixel is formed in pixel density of 400 dpi in the main scan direction and an auxiliary scan direction.

Next, the printing paper 20 is advanced by 1333.5 μm in the auxiliary scan direction, and the printing head 22 then performs the main scan again. As is the case with a first scan, the pixel is formed.

The above print is repeated, so that the print is performed over all the printing paper 20 at the pixel density of 400 dpi in the main scan and auxiliary scan directions.

A dot diameter of the ink droplet w ejected from the ink droplet eject apparatus is measured on the printing paper 20. At this time, when the droplet diameter of the ink droplet w is defined as the diameter of 36 μm and the modulation is performed up to maximum, the dot diameter is about 90 μm. When the print is performed at a density of about 400 dpi, even if a solid print is performed, the appropriate diameter of the ink droplet with good resolution is confirmed.

When the diameter of the ink droplet w is defined as about 7 μm, the dot diameter is about 15 μm on the printing paper 20 used in the embodiment. Gradation printing can be performed within the range of the dot diameter from about 90 μm to 15 μm.

Figure 9A:
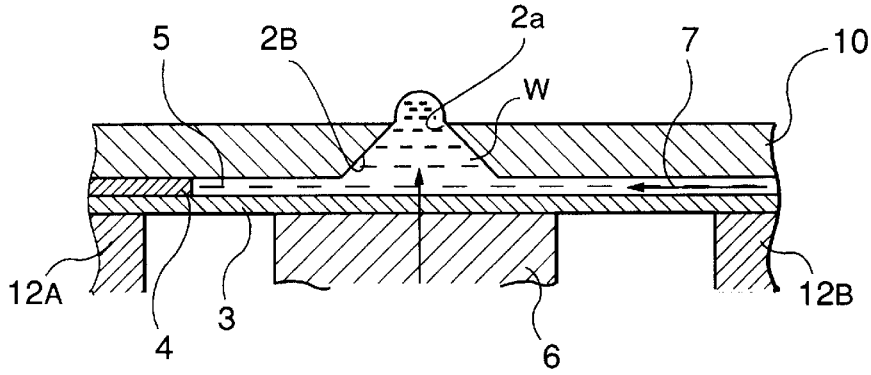
FIG. 9(A) shows a comparative example of the first embodiment of the present invention, showing the ejection of an ink droplet when a direct operation of a liquid flow causes the ejection of the ink droplet substantially as large as the diameter of an opening, and a state just prior to the generation of the ink droplet.
Figure 9B:
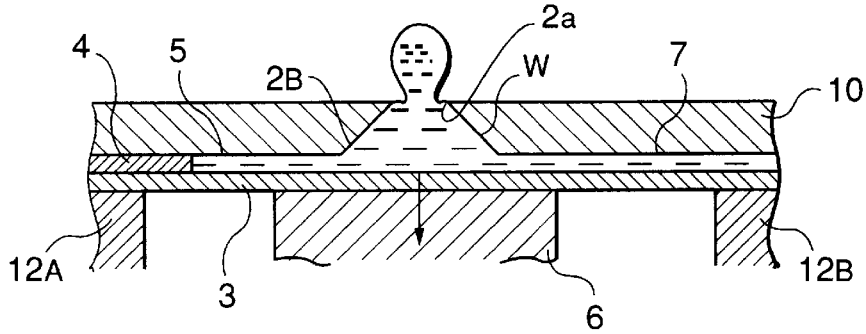
FIG. 9(B) shows the process of the generation of the ink droplet of the example of FIG. 9(A).
Figure 9C:
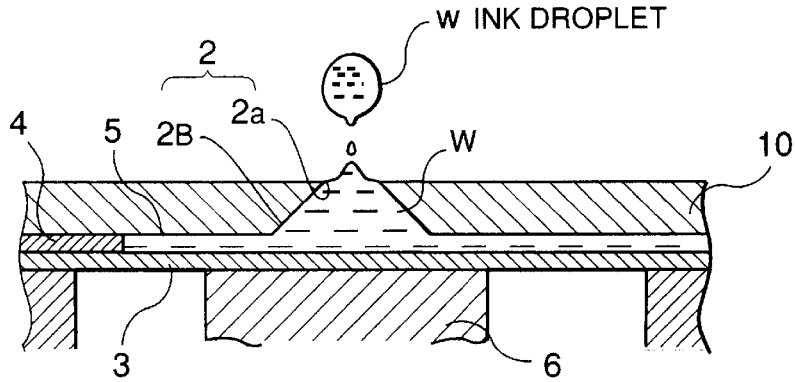
FIG. 9(C) shows the state just after the generation and ejection of the droplet of the example of FIG. 9(A).

In the first embodiment, a continuous liquid flow 13 adjusts drive conditions of the piezoelectric actuator 6 in such a manner that the ink droplet w is not ejected from the free surface of the ink W. Next, as a comparison example, the ejecting of the ink droplet w is attempted by the continuous operation of the liquid flow 13. FIG. 9 shows the eject process of the ink droplet w when the ink droplet w having substantially the same diameter as the diameter of the ink droplet eject port 2*a* is ejected by a continuous liquid flow 13.

In a liquid eject apparatus of the first embodiment, the drive time amplitude of the piezoelectric actuator 6 is 30 μs or more, and the displacement amplitude is 0.8 μm or more. At this time, as shown in FIG. 9, an eject mechanism using a conventional pump principle ejects the ink droplet w which is substantially as large as the diameter of the ink droplet eject port 2*a*.

On the contrary, when the drive time amplitude of the piezoelectric actuator 6 is extremely short and less than 1.5 μs, the experiment is repeated. In this case, at substantially the same time that the surface wave S is formed, a plurality of fine ink droplets w are ejected at random from the edge portion of the ink droplet eject port 2*a* and the end of the surface wave S. In this state, the diameter of the ink droplet w and the ejecting direction cannot be controlled for each droplet.

As described above, in order to eject the ink droplet w having the diameter smaller than the ink droplet eject port 2*a* with the control of a shot position, the liquid flow 13 must be generated in such a manner that the ink droplet w is not ejected form the free surface by a continuous liquid flow 13.

Next, a second embodiment will be described in detail with reference to FIGS. 10 and 11.

FIGS. 10 and 11 are plan views showing the ink droplet eject apparatus of the second embodiment of the present invention. FIG. 10 and 11 show a circular space 5 and a rectangular space 5, respectively.

In the second embodiment, as is the case with the first embodiment, the ink droplet eject apparatus has an ink droplet eject chamber 2 whose opening diameter is gradually enlarged in the direction of depth, a vibrating plate 3 connected to the bottom surface of the ink droplet eject chamber 2 and a piezoelectric actuator 6 connected to the vibrating plate 3. The ink droplet eject apparatus is used so as to supply the ink W from the ink tank 15 to the ink droplet eject chamber 2.

The dimensions of the ink droplet eject port 2*a* and the ink droplet eject chamber 2 are the same as those in the first embodiment. In the second embodiment, a tubular path area (the area of path surface of the ink flow path 7 facing the ink droplet eject port 2*a*) of the ink flow path 7 is set so that it may be larger than the area of an opening of the ink droplet eject port 2*a* of the ink droplet eject chamber 2.

That is, the ink flow path 7 and the annular space portion 5 are co-extensive. The height from both bottom surfaces to the ink droplet eject port 2*a* is 40 μm. Furthermore, as shown in FIG. 11, the plan shape of the space 5 is a square whose side is 360 μm. The dimension of the width of the ink flow path 7 is also defined as 360 μm and has the same width as the space 5. The tubular path area of the ink flow path 7 is 14400 $\mu m^2$. The area is about 1.8 times the 7850 $\mu m^2$ area of the ink droplet eject port 2*a*.

The dimensions of the width and height of the ink flow path 7 and the space 5 are the same. Accordingly, in the second embodiment, a long hole or a slot is formed corresponding to the ink flow path 7 and the space portion 5 on the same spacer member 4. The spacer member 4, on which the long hole is formed, is then bonded (laminated) between the vibrating plate 3 and the plate 10. The ink flow path 7 and the space 5 are thereby formed.

Even if the slot is worked corresponding to the ink flow path 7 and the space portion 5 on the bottom surface side of the spacer member 4 where the ink droplet eject port 2*a* and the cylindrical portion 2B are formed, the ink flow path 7 and the space 5 can be readily formed. Furthermore, since the ink flow path 7 and the space 5 can be formed on the same surface at the same time, the production of the ink droplet eject apparatus can be improved.

In order to investigate the ink droplet eject characteristics of the ink droplet eject apparatus, the ink W is sucked from the ink droplet eject port 2*a*, and the ink W is filled in the ink droplet eject chamber 2. A residual bubble in the eject chamber 2 is removed. Since the tubular path area of the ink flow path 7 is increased, the flow rate of the ink W flowing in the ink flow path 7 can be increased. A small suction applied the ink W from the ink droplet eject port 2*a* allows the bubble to be removed.

As is the case with the first embodiment, the piezoelectric actuator 6 effects displacement of cosine curved time response and time amplitude of 10 μs, and the ejected ink droplet w and the displacement amplitude are investigated. As a result, the ink droplet w of about 30 μm in diameter can be stably ejected from the ink droplet eject point 1 with the displacement amplitude of 0.44 μm.

If the drive time amplitude of the piezoelectric actuator 6 is changed to 20 μs, 5 μs and 3 μs, and the displacement amplitude is increased by about 10% more than the displacement amplitude of the first embodiment, ink droplets w are ejected in diameters of about 36 μm, 15 μm and 7 μm.

In the second embodiment, as is the case with the first embodiment, unlike the ink droplet eject apparatus using the prior-art pump principle, the interference of the surface wave causes the ink droplet w to be ejected. Therefore, even if the tubular path area of the ink flow path 7 is larger than the ink droplet eject port 2*a*, the surface wave can be generated, and the ink droplet w can be ejected.

It is possible to eject, drop by drop, the ink droplet w much smaller than the ink droplet eject port 2*a*. The diameter of the ink droplet w can be varied by the drive of the piezoelectric actuator 6. Modulation recording of the dot diameter can thus be realized.

In the ink droplet eject apparatus described above, as is the case with the first embodiment, the apparatus construction shown in FIG. 7 is applied to the ink jet printing head. The drive time amplitude and the displacement amplitude of the piezoelectric actuator 6 are modulated for each pixel and the diameter of the ink droplet w is modulated, to perform a print experiment.

As a result, pixels can be formed in a pixel density of 400 dpi in the main scan and auxiliary scan directions. Gradation recording can be performed within the range of the dot diameter from, at maximum, about 90 μm to 15 μm.

Furthermore, in the first embodiment, the length of the flow direction of the ink W in the ink flow path 7 is about 100 μm. The ink droplet eject chambers 2 are arranged so that the pitch B between the ink droplet eject ports 2*a* shown in FIG. 6 may be 600 μm. In the second embodiment, the length of the ink flow path 7 is about 200 μm. With this, the pitch B is increased to 700 μm. With the same drive time amplitude and displacement amplitude of the piezoelectric actuator 6 as in the first embodiment, it is possible to eject the same ink droplet w as in the first embodiment.

In the second embodiment, the plan shape of the space 5 is a square whose side is 360 μm. As shown in FIG. 10, if the plan shape of the space portion 5 is semicircular, when the residual bubble in the ink droplet eject chamber 2 is removed by the suction of the ink W from the ink droplet eject port 2*a* or the like, a lesser amount of suction allows the bubble to be removed.

Next, a third embodiment will be described with reference to FIGS. 12 and 13.

In the third embodiment, as shown in FIG. 12, the ink droplet eject apparatus is provided with two flow paths, that is, one ink flow path 7 supplying the ink W from the ink tank 15 to the ink droplet eject chamber 2 and the other ink flow path 7 discharging the excess of the ink W to the opposite ink tank 15.

The dimensions of the ink droplet eject port 2*a* and the base of conical portion 2B of the ink droplet eject chamber 2 are 100 μm and 300 μm in diameter, respectively. The dimension of the space 5 is 40 μm in the depth direction. The dimension of the ink droplet eject chamber 2 is 140 μm in the depth direction i.e., from port 2*a* to plate 3. These dimensions are also the same as those in the first embodiment. In the second embodiment, more specifically, the plan shape of the space 5 is a circle whose diameter is 360 μm. Between the piezoelectric actuator 6 and the vibrating plate 3 is disposed a circular plate whose diameter is 330 μm. Thus, a drive area 6S is a circle in shape whose diameter is 330 μm.

A position relationship between the ink flow paths 7 and the spaces 5 is set so that all bottom surfaces may be located on the same plane and the height dimensions from all bottom surfaces toward the ink droplet eject port 2*a* may be the same.

Moreover, in the third embodiment, when the ink droplet eject chamber 2 is filled with the ink W, or when the residual bubble in the ink droplet eject chamber 2 is removed, the ink droplet eject port 2*a* is closed, and the ink W is then sucked from the end of the ink flow path 7 on the exit side of the ink W (the ink tank 15 on the exit side of the ink W), thereby allowing the bubble to be removed.

When the ink W is sucked from both the ink droplet eject port 2*a* and the ink tank 15 on the exit side of the ink W, the flow rate of the ink W flowing in the ink flow path 7 can be increased, thereby allowing the bubble to be instantaneously removed.

In this construction, the suction amount of the ink W necessary for the removal of the bubble can be reduced so as to be equal to or less than ½ of the amount of the ink droplet eject apparatus having one ink flow path 7 for supplying the ink W.

In the ink droplet eject apparatus of the third embodiment, the ink droplet eject characteristics is also investigated.

The ink droplet eject chamber 2 is filled with the ink W. As is the case with the first embodiment, the piezoelectric actuator 6 effects a displacement of cosine curved time response for a time amplitude of 10 μs. At this time, an ink droplet w of about 30 μm in diameter can be stably ejected from the ink droplet eject point 1.

When the drive time amplitude of the actuator 6 is changed to 20 μs, 5 μs and 3 μs, as is the case with the first embodiment, ink droplets w of about 36 μm, 15 μm and 7 μm in diameter can be ejected. It is thus possible to eject, drop by drop, ink droplets w much smaller than the ink droplet eject port 2*a*. The change in the drive of the piezoelectric actuator 6 permits a gradation printing.

This ink droplet eject apparatus is applied to the ink jet printing head having the apparatus construction shown in FIG. 7, and a print experiment is carried out.

The ink droplet eject apparatus of the third embodiment comprises the two flow paths, that is, one ink flow path 7 supplying the ink W to the ink droplet eject chamber 2 and the other ink flow path 7 discharging the excess ink W.

The lengths of both the ink flow paths 7 on the supply and exit sides of the ink W are 100 μm. The ink droplet eject chamber 2 is arranged so that the pitch B between the ink droplet eject ports 2*a* shown in FIG. 6 may be 80 μm.

The pitch between the ink droplet eject ports 2*a* of the third embodiment is different from that of the first embodiment. Thus, the control of the electrical printing signal applied to each ink droplet eject apparatus is changed so as to perform the print experiment. As a result, pixels can be formed in a pixel density of 400 dpi in the main and auxiliary scan directions. Gradation printing of the dot diameter can be also performed.

The ink flow path 7 and the space 5 of the ink droplet eject chamber 2 have bottom surfaces on the same plane. The height dimensions from both the bottom surfaces to the ink droplet eject port 2*a* are the same, and the width dimensions are also the same 360 μm, as shown in FIGS. 10, 11 and 13, or different, as in FIG. 12. As is the case with the first embodiment, such an ink droplet eject apparatus is applied to the printing head 22 having the apparatus construction shown in FIG. 7.

With the same drive time amplitude of the piezoelectric actuator 6 as the first embodiment, the print experiment is performed. As a result, the displacement amplitude is increased by about 10% relative to the displacement amplitude of the first embodiment, thereby allowing the ink droplet w to be ejected similarly to the first embodiment. Image printing and modulation of the dot diameter can be performed.

In the ink droplet eject apparatus having the arrangement of the ink droplet eject ports 2*a* shown in FIG. 13, in order to remove a bubble in the liquid eject chamber 2, the ink W is sucked from both the ink droplet eject port 2*a* and the ink flow path 7. At this time, since the tubular path area of the ink flow path 7 is large, the flow rate of the ink W flowing in the ink flow path 7 can be further increased. The suction amount of the ink W necessary for the removal of the bubble can be further reduced to ⅔ that of the first embodiment.

The height and width dimensions of the ink flow path 7 and the space 5 may be the same. Accordingly, a long slot is formed defining the ink flow path 7 and the space 5 on the same spacer member 4. The spacer member 4 is then bonded between the vibrating plate 3 and the member 10. The ink flow path 7 and the space 5 can thus be easily formed.

Since the ink flow path 7 and the space 5 can be formed on the same surface at the same time, the production of the ink droplet eject apparatus can be improved.

Figure 15:
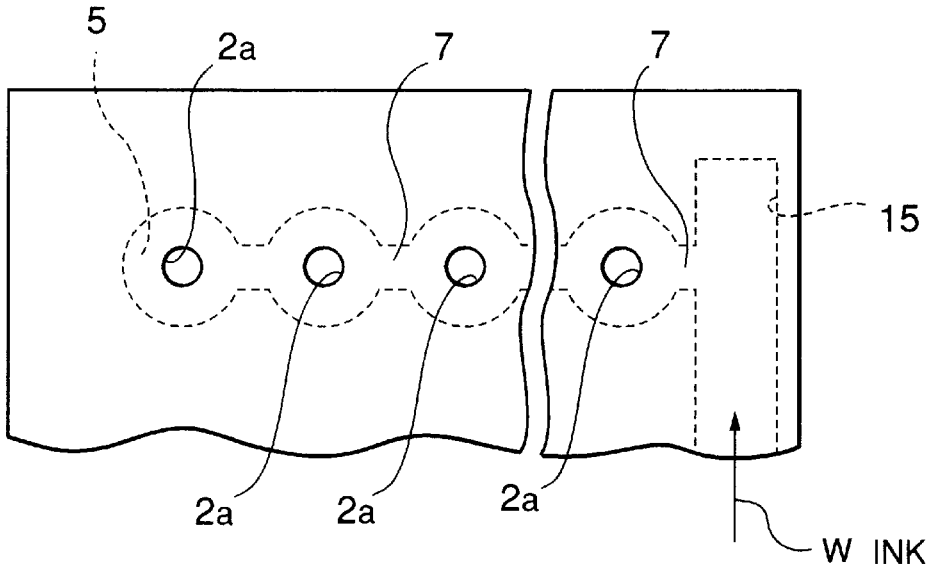
FIG. 15 shows the relationship among the ink droplet eject ports, the space portion and the ink tank of the fourth embodiment shown in FIG. 14.
Figure 16:
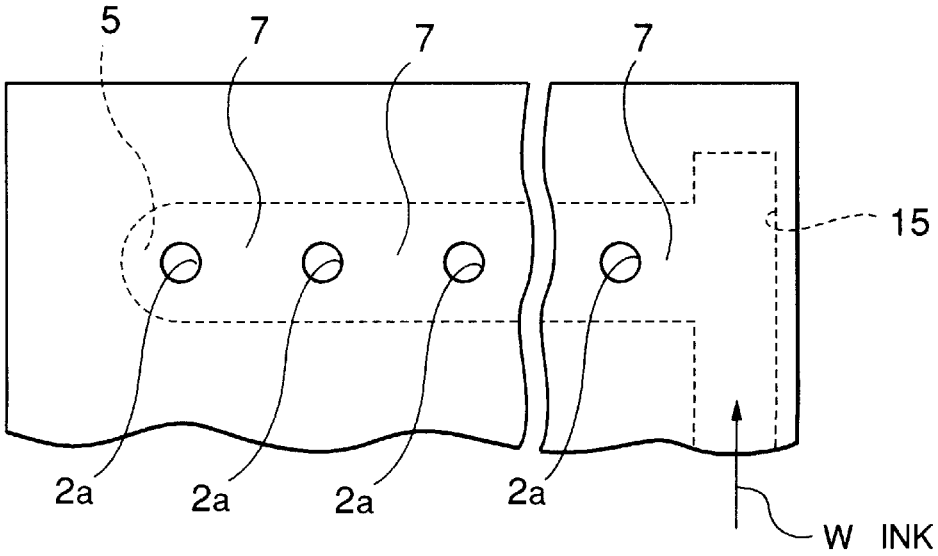
FIG. 16 shows the variation (when the tubular path area of the ink flow path is changed) of FIG. 15.

In the fourth embodiment shown in FIGS. 14(A) to 16, a plurality of ink droplet eject chambers are connected in series. FIGS. 15 and 16 are plan views of the ink jet printing head comprising the ink droplet eject apparatus of the fourth embodiment, showing the different path areas of the flow path.

In the fourth embodiment, as is the case with the first embodiment, the ink droplet eject apparatus comprises the vibrating plate 3 and the piezoelectric actuator 6.

As shown in FIGS. 14(B) and 15, the adjacent ink droplet eject chambers 2 are connected in series through each ink flow path 7 on the supply and exit sides of the ink W. As shown in FIG. 16, a plurality of ink droplet eject chambers 2 are arranged with a common ink flow path 7 surrounding them.

In this case, as shown in FIG. 16, one end of the ink flow path 7 is connected to the ink tank 15. The ink W is supplied from the ink tank 15 to the ink droplet eject chamber 2. The bottom surfaces of the ink flow path 7 and the spaces 5 of the ink droplet eject chamber 2 are located on the same plane. The height dimensions from both the bottom surfaces to the base of the opening are 40 μm.

In FIG. 5, the width dimension of the ink flow path 7 is 200 μm. The plan shape of the space 5 is a circle whose diameter is 350 μm.

In the ink droplet eject apparatus shown in the fourth embodiment, the height dimensions of the ink flow path 7 and the space portion 5 are the same. The construction is so simple that the ink flow path 7 passes through a plurality of ink droplet eject chambers 2. Thus, a band slit and a circular hole are formed on the same plate member 4. The plate member 4 is then bonded between the vibrating plate 3 and the eject chamber forming member 10 on which the ink droplet eject port 2*a* and the cylindrical portion 2B are formed. The ink flow path 7 and the space 5 are formed.

In this case, the slot and the hole may be formed corresponding to the ink flow path 7 and the space 5 on the bottom surface side of the eject chamber forming member 10 on which the ink droplet eject port 2*a* and the cylindrical portion 2B are formed.

It is not necessary to arrange the ink flow path 7 w supplying the ink W to each ink droplet eject chamber 2. The miniaturization and productivity of the ink droplet eject apparatus can be greatly improved.

Furthermore, in the fourth embodiment, the total length of the ink flow path 7 can be shorter than that of the ink flow path 7 of the first embodiment. When the ink W is sucked from the ink droplet eject port 2*a* so as to remove the bubble in the ink droplet eject chamber 2, the flow rate of the ink W can be increased. Thus, the suction amount of the ink W necessary for the removal of the bubble can be reduced to about ⅓ that in the first embodiment.

As is the case with each embodiment, the ink droplet eject characteristics of the ink droplet eject apparatus is investigated. As a result, the piezoelectric actuator 6 is provided with the displacement of cosine curved time response of the time amplitude of 10 μs and the displacement of 0.44 μm. The ink droplet w of about 30 μm in diameter can be stably ejected from the ink droplet eject point 1.

When the drive time amplitude of the piezoelectric actuator 6 is changed to 20 μs, 5 μs and 3 μs, as is the case with the first embodiment, the ink droplets w of about 36 μm, 15 μm and 7 μm in diameter can be ejected. Furthermore, the apparatus construction shown in FIG. 7 is applied to the ink jet printing head. When the drive time amplitude and the displacement amplitude of the piezoelectric actuator 6 are changed so as to modulate the diameter of the ink droplet w, the print experiment is performed.

In the fourth embodiment, the pitch A between the ink droplet eject ports 2*a* is 381 μm, as the first embodiment shown in FIG. 6. Although the pitch B is 600 μm in the first embodiment, the pitch B can be reduced to 380 μm in the fourth embodiment.

One ink flow path 7 passes through ten ink droplet eject chambers 2. The group of the ink droplet eject ports 2*a* is arranged in six columns in the staggered pattern. The two groups of the ink droplet eject ports 2*a* in six columns in the staggered pattern are disposed. The printing head 22 is produced so that the 120 ink droplet eject ports 2*a* may be arranged in total.

In this case, the pixel can be formed in the pixel density of 400 dpi in the main and auxiliary scan directions. The gradation printing can be performed within the range of the dot diameter from, at maximum, about 90 μm to 15 μm.

In the fourth embodiment, the plan shape of the space portion 5 is the circle whose diameter may be 360 μm. As shown in FIG. 16, the height dimensions are the same from both the bottom surfaces of the ink flow path 7 and the space 5 to the opening. In addition to this, the width dimensions are also the same 360 μm. In such an ink droplet eject apparatus, when the ink droplet eject characteristics is investigated and the ink droplet eject apparatus is applied to the ink jet printing head, the print experiment is performed.

The displacement amplitude is increased by more 5 than each embodiment, the ink droplet w can be ejected similarly to the first embodiment. The flow rate of the ink W flowing in the ink flow path 7 can be further increased. The suction amount of the ink W necessary for the removal of the bubble can be further reduced to ⅔ that in the first embodiment.

The width dimensions of the ink flow path 7 and the space 5 are the same. Their height dimensions are also the same. The band long hole can be formed on the same plate. The spacer member 4 is then bonded between the vibrating plate 3 and the member 10. Thus, the ink flow path 7 and the space portion 5 can be easily formed.

In such a manner, in the fourth embodiment, since the ink flow path 7 and the space 5 can be formed on the same surface plate member 4 at the same time, the production of the ink droplet eject apparatus can be improved.

Next, a fifth embodiment will be described with reference to FIGS. 17 and 18.

The fifth embodiment shown in FIGS. 17 and 18 is characterized in that the shape of the space portion 5 is varied and a suction port 27 is additionally disposed.

That is, in the ink droplet eject apparatus of the fifth embodiment, adjacent ink droplet eject chambers 2 are connected in series through two ink flow paths 7 on the supply and exit sides of the ink W. The ink flow path 7 is arranged so that it may pass through a plurality of ink droplet eject chambers 2. One end of the ink flow path 7 is connected to the ink tank 15. The other end of the ink flow path 7 is connected to the suction port 27 for sucking the ink W.

In the fifth embodiment, the ink droplet eject apparatus is used which generally has the same construction of the fourth embodiment. The bottom surfaces of the ink flow path 7 and the space portion 5 are located on the same surface. The height dimensions from both the bottom surfaces to the ink droplet eject port 2*a* are the same 40 μm. Furthermore, the width dimensions are the same 360 μm.

In the fifth embodiment, the construction is so simple that the ink flow path 7 passes through a plurality of ink droplet eject chambers 2. The band slit alone is formed on the same spacer member 4. The spacer member 4 is bonded between the vibrating plate 3 and the plate on which the ink droplet eject port 2*a* and the cylindrical portion 2B are formed. Thus, the ink flow path 7 and the space 5 are formed.

When the ink droplet eject chamber 2 is filled with the ink W, or when the residual bubble in the ink droplet eject chamber 2 is removed, the following operations are alternately performed: the ink droplet eject port 2*a* is closed so as to suck the ink W from the suction port 27; and the suction port 27 is closed so as to suck the ink W from the ink droplet eject port 2*a*. The flow rate of the ink W flowing in the ink flow path 7 can be increased, thereby allowing the bubble to be instantaneously removed.

Compared to the ink droplet eject apparatus of the fourth embodiment which is similarly constructed and does not have the suction port 27, the suction amount of the ink W necessary for the removal of the bubble can be reduced to ¼ or less.

In the fifth embodiment, the suction port 27 is disposed on the surface where the ink droplet eject port 2*a* is formed. However, as shown in FIG. 18, if the suction port 27 is disposed on the different surface from the ink droplet eject port 2*a*, a similar effect can be obtained.

In such a manner, as is the case with the fourth embodiment, when the fifth embodiment is applied to a printing head 22 having the apparatus construction shown in FIG. 7, image recording can be performed by the ink jet type, and the modulation of the dot diameter can be performed.

Next, a sixth embodiment will be described with reference to FIGS. 19(A) and 19(B).

As shown in FIG. 19(A), the sixth embodiment shown in FIGS. 19(A) and 19(B) comprises an circular (annular) annular member 4K. The annular member 4K is disposed on the bottom surface of the conical portion 2B. The inner diameter of the annular member 4K is the same 300 μm as that of the conical portion 2B. The height of the annular member 4K is 5 μm.

When the annular member 4K is disposed on the bottom of the conical portion 2B and the piezoelectric actuator 6 is driven, the leakage of the ink W toward the ink flow path 7 is suppressed. The liquid flow from the bottom surface to the ink droplet eject port 2*a* can be efficiently generated.

As a result, compared to the first embodiment, the surface wave can be more efficiently generated. When the piezoelectric actuator 6 is provided with time response displacement with time amplitude of 10 μs, the displacement amplitude necessary for the stable ejection of the ink droplet w of about 30 μm in diameter from the ink droplet eject point 1, can be reduced to 0.35 μm.

When the drive time amplitude of the piezoelectric actuator 6 is changed, as is the case with the first embodiment, the displacement necessary for the ejection of the ink droplet w can be reduced by about 10%.

In this case, when the annular member 4K has the same diameter and height as described above, as shown in FIG. 19(B), if the annular member 4K is disposed on the vibrating plate 3, a similar reduction of the displacement can be obtained.

In each embodiment described above, the ink droplet eject chamber 2 has a conical portion 2B. On the other hand, the portion 2B may have an axially curved inner surface or have surface roughness and/or discontinuities, provided the portion 2B has an opening that gradually increases in the depth direction. The reason is that such a construction allows the surface wave progressing in the direction of the ink droplet eject point 1 to be formed on the free surface of the ink W of the ink droplet eject port 2*a*. This can be experimentally confirmed.

In each of the first to fifth embodiments, the piezoelectric actuator 6 is disposed directly below the ink droplet eject port 2*a*. If the circular surface wave S can be generated which is spaced at generally equal distance from the ink droplet eject point 1 while progressing in the direction of the ink droplet eject point 1, the piezoelectric actuator 6 is not necessarily disposed directly below the ink droplet eject port 2*a*.

In each embodiment described above, although a piezoelectric element is used as the piezoelectric actuator 6 for supplying the displacement to the vibrating plate 3, for example, an electromagnetic actuator may be used, or any other drive which can supply a desired displacement to the vibrating plate 3.

In each embodiment described above, although the displacement of the piezoelectric actuator 6 is transmitted to the ink W through the vibrating plate 3, the piezoelectric actuator 6 may supply the displacement directly to the ink W.

The present invention is described above applied to a printer. However, the present invention may also be applied to any other liquid eject type printing equipment which functions in a similar way. Modifications of the invention herein disclosed will occur to a person skilled in the art and all such modifications are deemed to be within the scope of this invention as defined by the appended claims.

What is claimed is:

1. An ink droplet eject apparatus comprising a member defining an ink droplet eject chamber having an ink droplet eject port and an opening located opposite the ink droplet eject port, said ink droplet eject chamber being of decreasing cross-sectional area approaching said ink droplet eject port;

a vibrating plate facing said opening and supported so as to vibrate freely in a wider area than said opening; and an actuator for intermittently exciting said vibrating plate so as to generate an intermittent liquid flow of ink toward said ink droplet eject port from said vibrating plate, the liquid flow producing a controlled surface wave progressing toward a central point in said ink droplet eject port.

2. The apparatus according to claim 1, further comprising a spacer disposed between said vibrating plate and said member surrounding said opening of said ink droplet eject chamber and spacing said vibrating plate a predetermined distance from said member.

3. The apparatus according to claim 1, wherein a drive area of said actuator connected to said vibrating plate is larger than said opening.

4. The ink droplet eject apparatus according to claim 2, wherein said spacer defines an ink flow path communicating with a peripheral space delimited by the spacer and formed between said vibrating plate and said member.

5. The ink droplet eject apparatus according to claim 4, wherein said ink flow path comprises at least one ink supply path to said ink droplet eject chamber and at least one discharge path for excess ink.

6. The ink droplet eject apparatus according to claim 5, wherein a plurality of said ink droplet eject chambers are spaced from each other at a predetermined distance in a row, and further comprising ink tank portions disposed on both sides of said row, a said ink flow path being provided for each of said plurality of ink droplet eject chambers.

7. The ink droplet eject apparatus according to claim 1, wherein said actuator is driven by a signal having a cosine waveform.

8. An ink droplet eject apparatus comprising:

a plate-shaped member including an ink droplet eject chamber having an ink droplet eject port on one surface and a conical section;

a vibrating plate facing an opposite surface of said plate-shaped member so as to cover said ink droplet eject chamber at a predetermined distance;

a spacer disposed between said vibrating plate and said eject chamber forming member surrounding said ink droplet eject chamber and delimiting an annular space lying outwardly of said ink droplet eject chamber between said vibrating plate and said plate-shaped member;

an ink flow path defined by said space portion and formed between said vibrating plate and said plate-shaped member;

an actuator connected to said vibrating plate for intermittently exciting said vibrating plate to generate an intermittent liquid flow of an ink in said ink droplet eject chamber from a bottom surface thereof toward said ink droplet eject port; and an actuator driver driving said actuator so as to control an amount and a generation time of displacement of said vibrating plate during an intermittent excitation, wherein a plurality of said ink droplet eject chambers are spaced from each other at a predetermined distance in a row, and further comprising an ink tank portion disposed on one end in a longitudinal direction of said row, adjacent said annular spaces being interconnected by alternate ink flow paths, and wherein a suction port for sucking said ink is disposed on the other end in the longitudinal direction of said row.

9. An ink droplet eject apparatus comprising:

a plate-shaped member including an ink droplet eject chamber having an ink droplet eject port on one surface and a conical section;

a vibrating plate facing an opposite surface of said plate-shaped member so as to cover said ink droplet eject chamber at a predetermined distance;

a spacer disposed between said vibrating plate and said eject chamber forming member surrounding said ink droplet eject chamber and delimiting an annular space lying outwardly of said ink droplet eject chamber between said vibrating plate and said plate-shaped member;

an ink flow path defined by said space portion and formed between said vibrating plate and said plate-shaped member;

an actuator connected to said vibrating plate for intermittently exciting said vibrating plate to generate an intermittent liquid flow of an ink in said ink droplet eject chamber from a bottom surface thereof toward said ink droplet eject port; and an actuator driver driving said actuator so as to control an amount and a generation time of displacement of said vibrating plate during an intermittent excitation, wherein a circular or polygonal annular member is disposed in a boundary region between said ink droplet eject chamber and said annular space, the height of said annular member being less than the thickness of said space portion.

10. The apparatus according to claim 9, wherein said annular member is disposed on said plate-shaped member adjacent the bottom surface of said ink droplet eject chamber.

11. The apparatus according to claim 9, wherein said annular member is disposed on said vibrating plate adjacent the bottom surface of said ink droplet eject chamber.

12. An ink droplet ejecting method in an apparatus comprising a member defining an ink droplet eject chamber having an ink droplet eject port and an opening, and a vibrating plate facing said opening, comprising the steps of:

exciting said vibrating plate intermittently so as to generate an intermittent liquid flow of an ink toward said ink droplet eject port from said vibrating plate;

generating a controlled surface wave progressing from a periphery of said ink droplet eject port toward a central said ink droplet eject port; and causing said surface wave to undergo controlled interference so as to eject from said central axis an ink droplet whose diameter is substantially smaller than a smallest diameter of said eject port, wherein said exciting step comprises:

generating a signal having a waveform, pulse width, and amplitude corresponding to a desired printing signal; and independently applying said signal to an actuator for said vibrating step according to said printing signal, and wherein said signal has a cosine waveform.

* * * * *